US010431942B2

(12) United States Patent
Watkins

(10) Patent No.: US 10,431,942 B2
(45) Date of Patent: Oct. 1, 2019

(54) COAXIAL CABLE CONNECTOR HAVING AN OUTER CONDUCTOR ENGAGER

(71) Applicant: PPC BROADBAND, INC., East Syracuse, NY (US)

(72) Inventor: Harold John Watkins, Chittenango, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/152,433

(22) Filed: Oct. 5, 2018

(65) Prior Publication Data

US 2019/0036281 A1 Jan. 31, 2019

Related U.S. Application Data

(63) Continuation-in-part of application No. 15/697,444, filed on Sep. 6, 2017, which is a continuation-in-part
(Continued)

(51) Int. Cl.
*H01R 24/38* (2011.01)
*H01R 9/05* (2006.01)
(Continued)

(52) U.S. Cl.
CPC ..... *H01R 24/38* (2013.01); *H01R 9/0527* (2013.01); *H01R 13/501* (2013.01);
(Continued)

(58) Field of Classification Search
CPC ..... H01R 9/0518; H01R 9/0524
(Continued)

(56) References Cited

U.S. PATENT DOCUMENTS 7,048,578 B2 5/2006 Rodrigues
7,131,868 B2 * 11/2006 Montena ..... H01R 9/0518 439/578
(Continued)

FOREIGN PATENT DOCUMENTS

WO 2017/016498 A1 2/2017

OTHER PUBLICATIONS

Jan. 21, 2019 Extended European Search Report issued in European Patent Application No. 16808328.5.
(Continued)

*Primary Examiner* — Abdullah A Riyami
*Assistant Examiner* — Nader J Alhawamdeh
(74) *Attorney, Agent, or Firm* — Oliff PLC

(57) ABSTRACT

A connector for a coaxial cable includes a coupler portion configured to engage an interface port, a housing portion having a forward end configured to be disposed at least partially within the coupler portion, and an outer conductor engager portion made of a conductive material disposed within the housing portion. The housing portion includes a rearward end configured to receive the coaxial cable, the housing portion is configured to move axially relative to the outer conductor engager portion, and an interior surface of the housing portion is configured to compress the outer conductor engager portion when the housing portion is moved axially relative to the outer conductor engager portion such that an interior surface of the outer conductor engager portion is compressed radially inward against an outer conductor of the coaxial cable.

20 Claims, 16 Drawing Sheets

Related U.S. Application Data of application No. 15/652,029, filed on Jul. 17, 2017, now Pat. No. 10,050,392, which is a continuation of application No. 15/178,062, filed on Jun. 9, 2016, now Pat. No. 9,711,918.

(60) Provisional application No. 62/254,171, filed on Nov. 11, 2015, provisional application No. 62/173,906, filed on Jun. 10, 2015.

(51) Int. Cl.
*H01R 13/58* (2006.01)
*H01R 13/50* (2006.01)
*H01R 24/40* (2011.01)

(52) U.S. Cl.
CPC ..... *H01R 13/582* (2013.01); *H01R 24/40* (2013.01); *H01R 2201/26* (2013.01)

(58) Field of Classification Search
USPC ..... 439/578, 475
See application file for complete search history.

(56) References Cited

U.S. PATENT DOCUMENTS 7,347,729 B2 * 3/2008 Thomas ..... H01R 4/5033 439/583
7,351,101 B1 4/2008 Montena
7,972,175 B2 * 7/2011 Chawgo ..... H01R 9/0521 439/583
8,038,472 B2 * 10/2011 Montena ..... H01R 24/564 439/578
8,075,338 B1 * 12/2011 Montena ..... H01R 24/40 439/578
8,079,860 B1 * 12/2011 Zraik ..... H01R 13/207 439/255
8,123,557 B2 * 2/2012 Montena ..... H01R 9/0527 439/584
8,167,636 B1 * 5/2012 Montena ..... H01R 9/0527 439/322
8,177,583 B2 * 5/2012 Chawgo ..... H01R 9/0524 439/584
8,323,053 B2 * 12/2012 Montena ..... H01R 9/0524 439/578
8,708,737 B2 * 4/2014 Chawgo ..... H01R 9/0524 439/578
9,130,281 B2 * 9/2015 Phillips, Jr. ..... H01R 9/0524
9,136,654 B2 9/2015 Matzen
2012/0252263 A1 10/2012 Ehret et al.
2014/0106614 A1 4/2014 Burris et al.
2014/0120766 A1 5/2014 Meister et al.
2016/0365683 A1 12/2016 Watkins

OTHER PUBLICATIONS

Nov. 20, 2018 International Search Report and Written Opinion issued in International Application No. PCT/US18/49814.

* cited by examiner

COAXIAL CABLE CONNECTOR HAVING AN OUTER CONDUCTOR ENGAGER

CROSS-REFERENCE TO RELATED APPLICATIONS

This is a continuation-in-part of U.S. application Ser. No. 15/697,444, filed Sep. 6, 2017, pending, which is a continuation-in-part of U.S. application Ser. No. 15/652,029, filed Jul. 17, 2017, now U.S. Pat. No. 10,050,392, which is a continuation of U.S. application Ser. No. 15/178,062, filed Jun. 9, 2016, now U.S. Pat. No. 9,711,918, which claims the benefit of U.S. Provisional Application No. 62/173,906, filed Jun. 10, 2015, and U.S. Provisional Application No. 62/254,171, filed Nov. 11, 2015. The disclosures of the prior applications are hereby incorporated by reference herein in their entirety.

TECHNICAL FIELD

The present disclosure relates to connectors for coaxial cables.

BACKGROUND

A coaxial cable is prepared for connection to another cable, or to another RF device, by a coaxial cable connector. Coaxial cable connectors must be securely crimped to coaxial cables to which they are attached. The crimp must at least mechanically secure the connector to the cable, and it is also desirable for the crimp to block out moisture. Preparation of the connector/cable typically requires the use of several specialized tools including a stripping tool and a compression tool. The stripping tool removes a portion of the compliant outer jacket to expose a signal-carrying inner conductor and an outer grounding, or braided, conductor of the cable. The compression tool, on the other hand, inserts a grounding/retention post into the prepared end of the cable to effect an electrical and mechanical connection between the cable and an outer body or housing of the cable connector.

The step of compressing/inserting the grounding/retention post into the prepared end of the coaxial cable also requires a holding fixture to align the prepared end of the cable while a driver compresses a barbed annular sleeve of the grounding/retention post into/beneath the outer jacket of the cable. As such, the outer jacket may be compressed between the barbed annular sleeve and a fixed-diameter outer housing of the cable connector. Compression of the outer jacket causes the barbed annular sleeve to engage the braided conductor of the cable, thereby retaining the grounding/retention post of the connector to the coaxial cable.

Post-less connectors have been recently introduced. Current designs feature a body which collapses under axial force and forms a sharp crimp that engages the exterior of the braided outer conductor.

Post-based crimping connectors have the disadvantages of being difficult to assemble and potentially damaging to the coaxial cable. Current post-less designs have the disadvantages of being expensive to manufacture and providing an inferior seal and coupling when certain forces are applied to the cable. There remains a need in the art for an improved coaxial cable connector.

SUMMARY

According to various aspects of the disclosure, a connector for a coaxial cable includes a coupler portion configured to engage an interface port, a housing portion having a forward end configured to be disposed at least partially within the coupler portion, and an outer conductor engager portion made of a conductive material disposed within the housing portion. The housing portion includes a rearward end configured to receive the coaxial cable, the housing portion is configured to move axially relative to the outer conductor engager portion, and an interior surface of the housing portion is configured to compress the outer conductor engager portion when the housing portion is moved axially relative to the outer conductor engager portion such that an interior surface of the outer conductor engager portion is compressed radially inward against an outer conductor of the coaxial cable.

In some embodiments, the outer conductor engager portion is configured to remain axially stationary relative to the coupler portion when the housing portion moves relative to the outer conductor engager portion.

In some embodiments, the housing portion includes a forward body portion configured to be received by a reward end of the coupler portion, a rearward body portion coupled with the forward body portion, and a sleeve portion surrounding the rearward body portion. According to various aspects, the coupler portion is configured to rotate relative to the forward body portion, the rearward body portion and the sleeve portion are configured to slide axially relative to the forward body portion, and an interior surface of the rearward body portion is configured to compress the outer conductor engager portion when the housing portion is moved axially relative to the outer conductor engager portion such that an interior surface of the outer conductor engager portion is compressed radially inward against an outer conductor of the coaxial cable.

According to various embodiments, the outer conductor engager portion includes resilient fingers that are configured to be compressed radially inward against an outer conductor of the coaxial cable when an interior surface of the rearward body portion compresses the outer conductor engager portion.

In some embodiments, the connector further includes a compression sleeve disposed at a rearward end of the rearward body portion, wherein the compression sleeve is configured to move the rearward body portion axially forward relative to the forward body portion to compress the resilient fingers radially inward against the outer conductor of the coaxial cable. According to various aspects, the compression sleeve is configured to move axially forward relative to the rearward body portion, after the resilient fingers are compressed radially inward against the outer conductor of the cable, so as to compress the rearward end of the rearward body portion against the coaxial cable.

In some embodiments, the coupler portion is configured to rotate relative to the housing portion.

According to some embodiments, the outer conductor engager portion includes resilient fingers that are configured to be compressed radially inward against an outer conductor of the coaxial cable when the housing portion is moved axially relative to the outer conductor engager portion. In some aspects, the connector further includes a compression sleeve disposed at a rearward end of the housing portion, wherein the compression sleeve is configured to move the housing portion axially forward relative to the outer conductor engager portion to compress the resilient fingers radially inward against the outer conductor of the coaxial cable. According to various aspects, the compression sleeve is configured to move axially forward relative to the housing portion, after the resilient fingers are compressed radially inward against the outer conductor of the cable, so as to compress the rearward end of the housing portion against the coaxial cable.

In various embodiments, the connector further includes a terminal pin configured to receive a center conductor of the coaxial cable, wherein the terminal pin is configured to extend through the coupler portion and to be connected to the interface port. According to some aspects, the connector further includes an isolator configured to electrically isolate the terminal pin from the coupler portion and/or an isolator configured to electrically isolate the center conductor from the outer conductor engager portion.

In some aspects, the coupler portion, the housing portion, and the outer conductor engager portion are separate structures that are coupled to one another.

In accordance with various aspects of the disclosure, a connector for a coaxial cable includes a coupler portion configured to engage an interface port, a housing portion having a forward end configured to be disposed at least partially within the coupler portion, and an outer conductor engager portion made of a conductive material disposed within the housing portion. The housing portion includes a rearward end configured to receive the coaxial cable, the housing portion is configured to move axially relative to the outer conductor engager portion, an interior surface of the housing portion is configured to compress the outer conductor engager portion when the housing portion is moved axially relative to the outer conductor engager portion such that an interior surface of the outer conductor engager portion is compressed radially inward against an outer conductor of the coaxial cable, the outer conductor engager portion is configured to remain axially stationary relative to the coupler portion when the housing portion moves relative to the outer conductor engager portion, a forward body portion of the housing portion is configured to be received by a reward end of the coupler portion and a rearward body portion is configured to be coupled with the forward body portion, the coupler portion is configured to rotate relative to the forward body portion, the rearward body portion is configured to slide axially relative to the forward body portion, an interior surface of the rearward body portion is configured to compress the outer conductor engager portion when the housing portion is moved axially relative to the outer conductor engager portion such that an interior surface of the outer conductor engager portion is compressed radially inward against an outer conductor of the coaxial cable, the outer conductor engager portion includes resilient fingers that are configured to be compressed radially inward against an outer conductor of the coaxial cable when an interior surface of the rearward body portion compresses the outer conductor engager portion, a compression sleeve is configured to be disposed at a rearward end of the rearward body portion, the compression sleeve is configured to move the rearward body portion axially forward relative to the forward body portion to compress the resilient fingers radially inward against the outer conductor of the coaxial cable, and the compression sleeve is configured to move axially forward relative to the rearward body portion, after the resilient fingers are compressed radially inward against the outer conductor of the cable, so as to compress the rearward end of the rearward body portion against the coaxial cable.

In some embodiments, the coupler portion, the forward body portion, the rearward body portion, and the outer conductor engager portion are separate structures that are coupled to one another.

According to various embodiments, the connector further includes a terminal pin configured to receive a center conductor of the coaxial cable, wherein the terminal pin is configured to extend through the coupler portion and to be connected to the interface port. In some aspects, the connector includes an isolator configured to electrically isolate the terminal pin from the coupler portion and/or an isolator configured to electrically isolate the center conductor from the outer conductor engager portion.

In some embodiments, the housing portion includes a nose cone, a body, and a sleeve, the sleeve surrounding the body, and the body and the sleeve being configured to slide axially relative to the nose cone.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
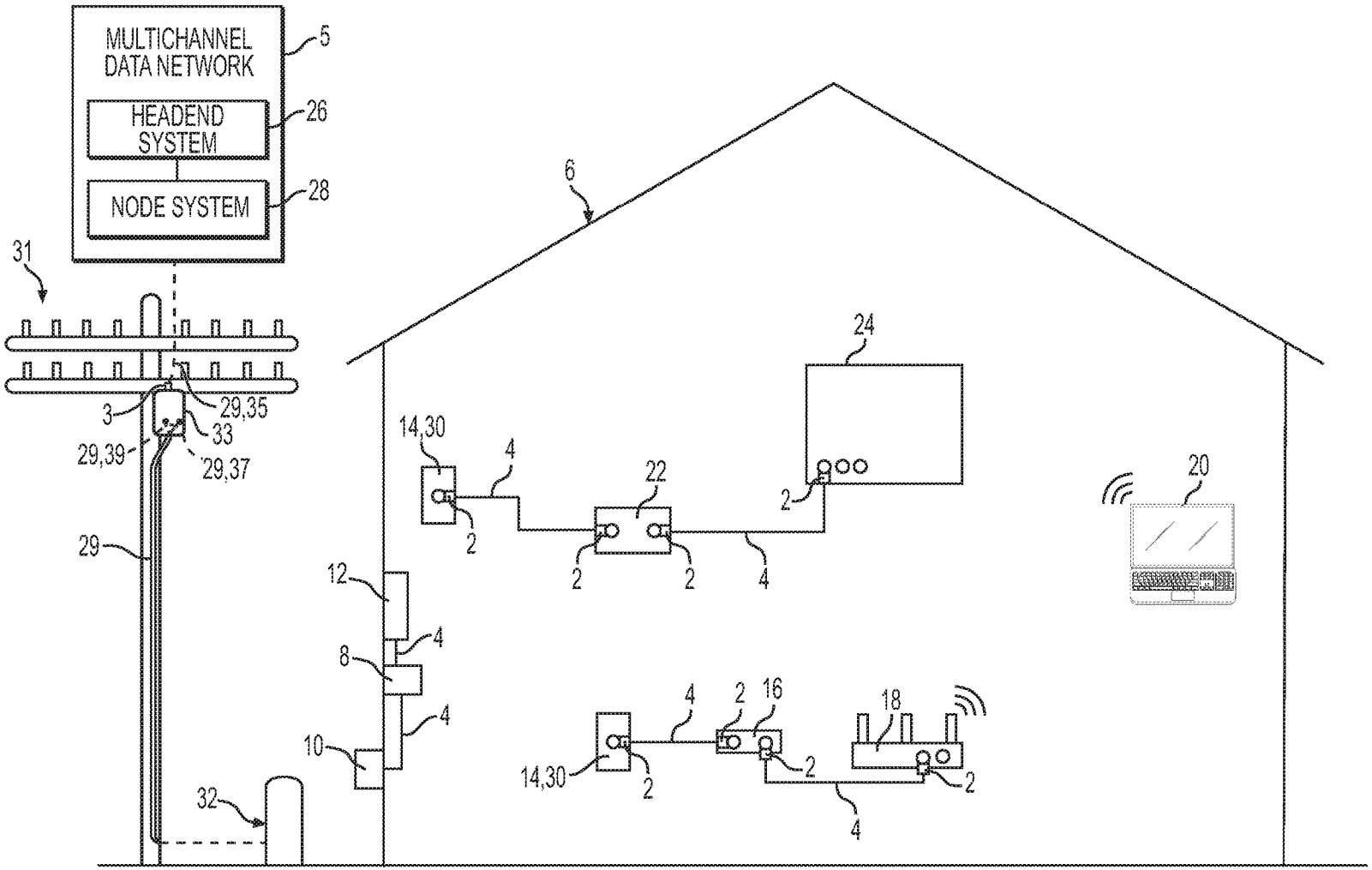
FIG. 1 is a schematic view of an exemplary network environment in accordance with various aspects of the disclosure.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF")

signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In some embodiments, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol ("VoIP") phone service, Internet Protocol TV ("IPTV") data streams, multimedia content, audio data, music, radio and other types of data.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
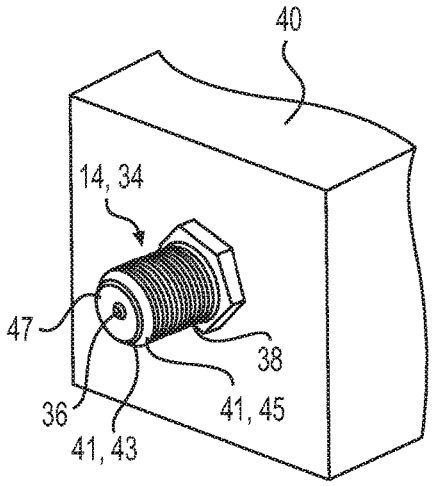
FIG. 2 is a perspective view of an exemplary interface port in accordance with various aspects of the disclosure.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In some embodiments, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34.

Figure 3:
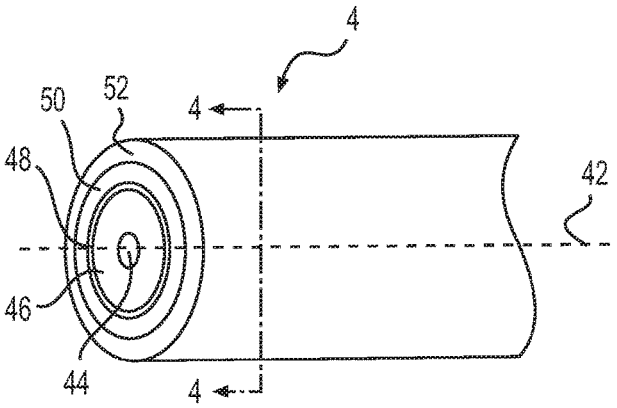
FIG. 3 is a perspective view of an exemplary coaxial cable in accordance with various aspects of the disclosure.
Figure 4:
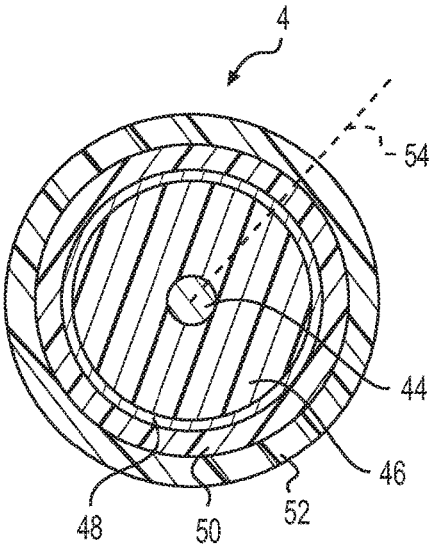
FIG. 4 is a cross-sectional view of the exemplary coaxial cable of FIG. 3.
Figure 5:
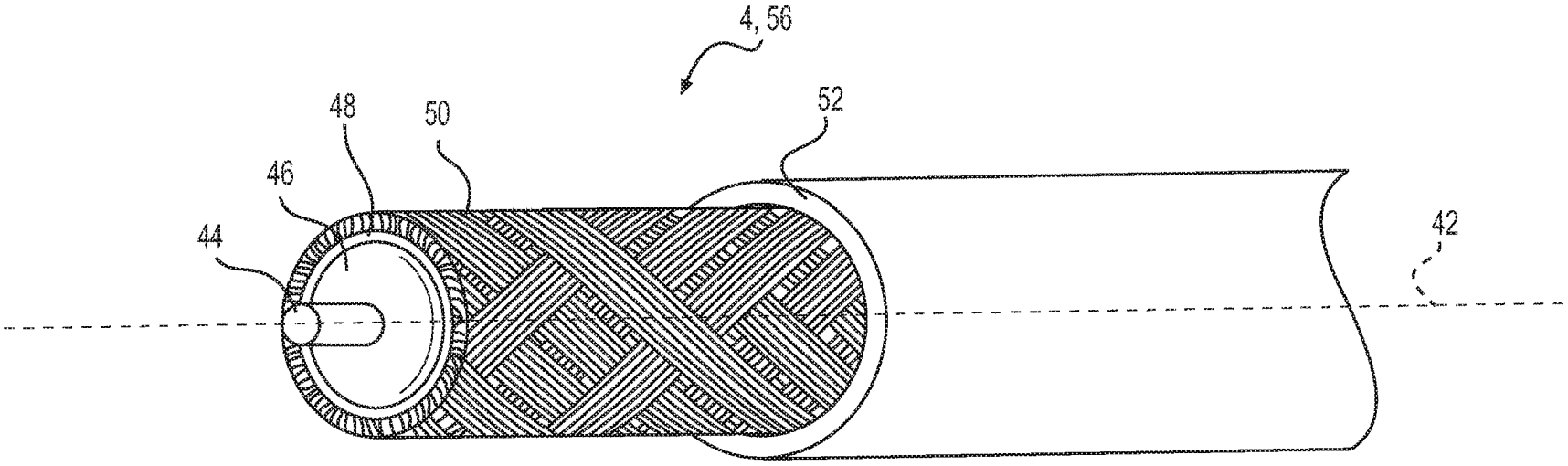
FIG. 5 is a perspective view of an exemplary prepared end of the exemplary coaxial cable of FIG. 3.

Referring to FIGS. 3-5, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in some embodiments, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, the connector 2 electrically grounds the outer conductor 50 of the coaxial cable 4. The conductive foil layer 48, in one embodiment, is an additional, tubular conductor which provides additional shielding of the magnetic fields. In one embodiment, the jacket 52 has a protective characteristic, guarding the cable's internal components from damage. The jacket 52 also has an electrical insulation characteristic.

Referring to FIG. 5, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a two step-shaped configuration. In some embodiments, the prepared end has a three step-shaped configuration (not shown), where the insulator 46 extends beyond an end of the foil 48 and outer conductor 50. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 6:
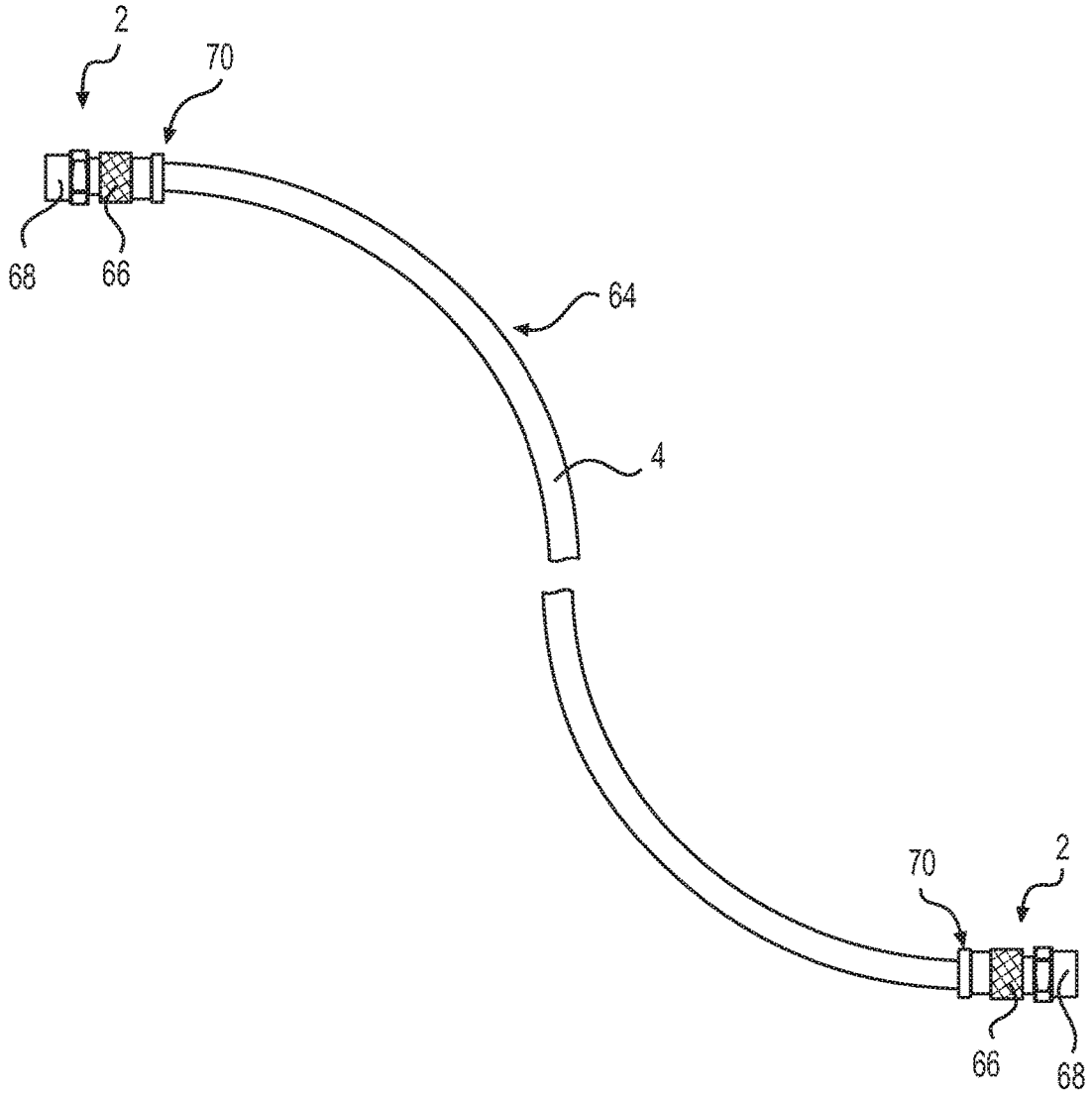
FIG. 6 is a top view of one embodiment of a coaxial cable jumper or cable assembly which is configured to be operatively coupled to the multichannel data network.
Figure 7:
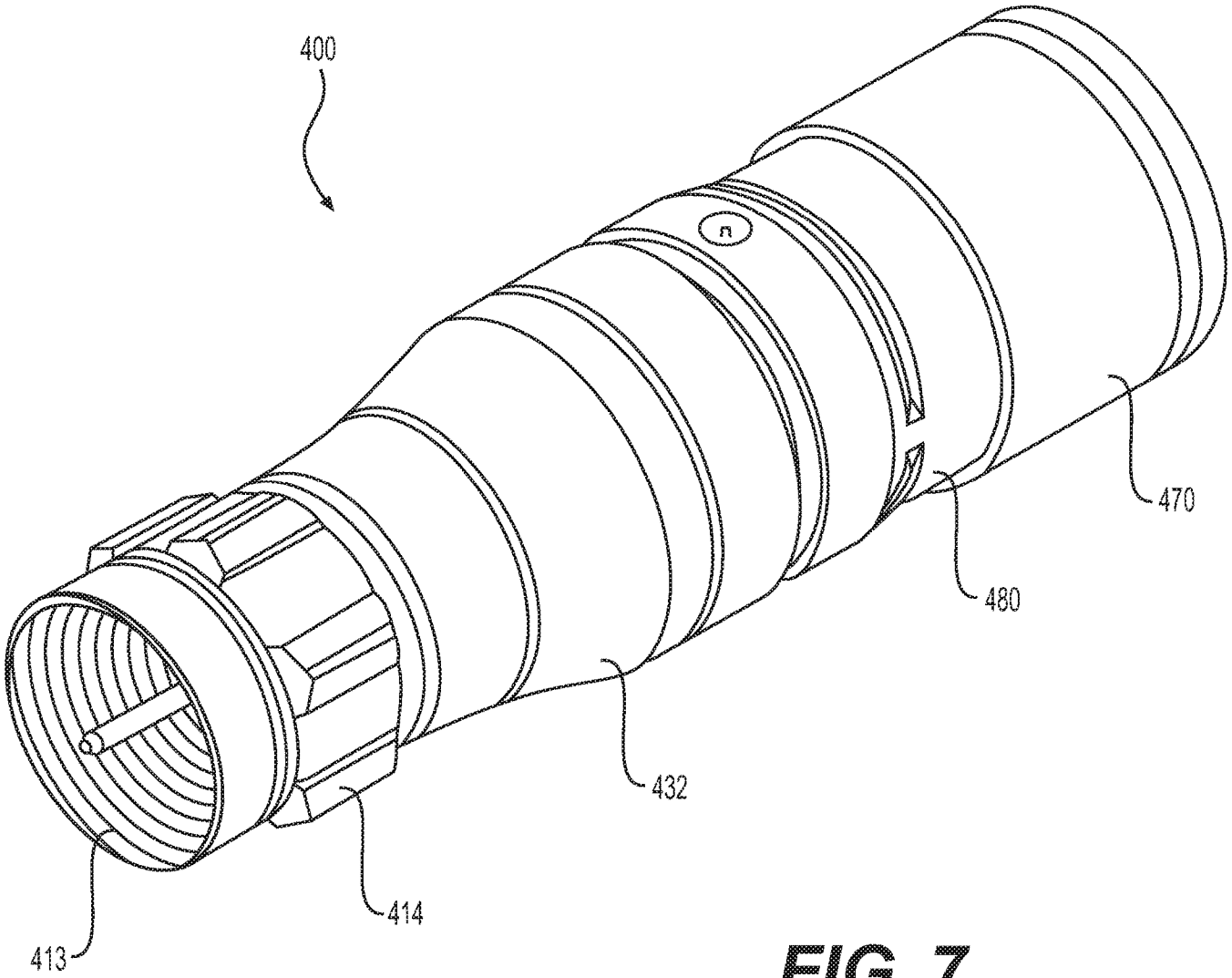
FIG. 7 is a perspective view of an exemplary connector in accordance with various aspects of the disclosure.

In one embodiment illustrated in FIG. 6, a cable jumper or cable assembly 64 includes a combination of the connector 2 and the cable 4 attached to the connector 2. In this embodiment, the connector 2 includes a connector body or connector housing 66 and a fastener or coupler 68, such as a threaded nut, which is rotatably coupled to the connector housing 66. The cable assembly 64 has, in one embodiment, connectors 2 on both of its ends 70. In some embodiments, the cable assembly 64 may have a connector 2 on one end and either no connector or a different connector at the other end. Preassembled cable jumpers or cable assemblies 64 can facilitate the installation of cables 4 for various purposes.

The cable connector of the present disclosure provides a reliable electrical ground, a secure axial connection and a watertight seal across leakage-prone interfaces of the coaxial cable connector.

The cable connector comprises an outer conductor engager or post, a housing or body, and a coupler or threaded nut to engage an interface port. The outer conductor engager includes an aperture for receiving the outer braided conductor of a prepared coaxial cable, i.e., an end which has been stripped of its outer jacket similar to that shown in FIG. 5, and a plurality of resilient fingers projecting axially away from the interface port. The body receives and engages the resilient fingers of the outer conductor engage to align the body with the outer conductor engager in a pre-installed state.

According to the disclosure, the aforementioned connectors 2 may be configured as coaxial cable connector 400, as illustrated in FIGS. 7-10. When the connector 400 is installed on an interface port 14, a forward end, portion, or direction is proximal to, or toward, the interface port 14, and a rearward end, portion, or direction is distal, or away, from the interface port 14.

Referring now to FIGS. 7-10, an embodiment of a connector 400, which may be formed by a nut sub-assembly 412 and a housing sub-assembly 430, is illustrated. The nut sub-assembly 412 includes a nut 414, a retainer 420, and a first insulator 422. The nut 414 has a threaded interior 413 at a first forward end 416 for connection to a termination device (e.g., an interface port) and a recessed opening 417 (see FIG. 8) at a second rearward end 418 for receiving a collar 434 of the housing sub-assembly 430. The nut 414 also has a lip 411 between the first and second ends 416, 418, which extends radially inward from the axial bore and reduces the inner diameter of the axial bore. The retainer 420 is cylindrically shaped and has a radially outer rim 419 on the first end, a plain second end 421 and an axial bore 415 between the two ends. When the retainer 420 is inserted into the nut 414, the rim 419 on the retainer 420 contacts the lip 411, which prevents further passage of the retainer 420 through the axial bore of the nut 414. The first insulator 422 has a first end 423, a second end 425, and an aperture 424 along the axis between the two ends 423, 425.

The nut sub-assembly 412 also includes a terminal pin 427, which is secured in the nut 414 by the first insulator 422 and the retainer 420. The terminal pin 427 has a solid pin end 426 for connecting to an electrical device (not shown) and a connector end 428 for receiving the center conductor 44 of a coaxial cable 4. In some aspects, the connector end 428 may include a Milmax-type connector 428' configured to securely grip the center conductor 44 of a cable 4. Alternatively, the connector end 428 may have a cylindrically-shaped wall with one or more slots and/or a plurality of circumferential grooves on the interior surface of the wall, which facilitate compression of the connector end and engagement of the center conductor 44 of a coaxial cable 4.

The solid pin end 426 is inserted into the aperture 424 in the first insulator 422 and is snugly secured in the first insulator 422. The solid pin end 426 and insulator 422 are secured in the nut 414 by the retainer 420, which is inserted into the nut 414 from the first end 416. The solid pin end 426 of the terminal pin 427 passes through the retainer 420 and extends beyond the first end 416 of the nut 414.

The housing sub-assembly 430 includes a nose cone 432 that has a collar 434 on a first end 431 and a latching feature 440 on a second end 433. The nose cone 432 receives, in sequential order, a second insulator 442, an outer conductor engager 450, a body 460, a sleeve 480, and a compression ring 470. The nose cone 432 is substantially cylindrical in shape and has a first section 436, a second section 438, and an axial bore that extends between a first end 431 and a second end 433. An O-ring 479 is fitted over the outer perimeter of the collar 434 of the nose cone 432. An O-ring (not shown) may be disposed between the nose cone 432, the outer conductor engager 450, and the body 460. The connector 400 may include a grounding member 499 disposed between the nut 414 and the nose cone 432, so that the grounding member 499 extends electrical grounding from the outer conductor engager 450, through the nose cone 432, and to the nut 414.

The second end 433 of the nose cone 432 receives a coaxial cable 4 having a center conductor 44 and an outer conductor 50. The connection between the terminal pin 427 and the center conductor 44 of the coaxial cable 4 is made in the first section 436 of the nose cone 432 and the coaxial cable 4 is secured in the second section 438 of the nose cone 432. When the nut sub-assembly 412 and the housing sub-assembly 430 are assembled, the second end 421 of the retainer 420 passes through the first end 416 of the nut 414 and is inserted into the collar 434 at the first end 431 of the nose cone 432. A flaring tool is then inserted into the second end 433 of the nose cone 432 and is used to flare a second end 421*a* of the retainer 420 outwardly, which secures the retainer 420 relative to the collar 434 of the nose cone 432. The O-ring 479 on the outside of the collar 434 forms a seal between the collar 434 and the nut 414. The solid pin end 426 of the terminal pin 427 (secured in the first insulator 422) is then passed through the second end 433 of the nose cone 432 and inserted in the retainer 420. The ends 423, 425 of the first insulator 422 snugly contact the interior wall of the axial bore 415 of the retainer 420 and secure the first insulator 422 and the terminal pin 427 in the retainer 420.

The second insulator 442 has a blank flange 443 at a first end 444, a plain second end 448, and an axial bore between the flange 443 at the first end 444 and the second end 448. The second insulator 442 has an aperture 446 that is sized to accommodate the center conductor 44 of the coaxial cable 4. The outside diameter of the flange 443 is sized so that it can pass through the second section 438 of the nose cone 432 and press fit snugly against the interior wall of the first section 436. In some aspects, the connector end 428 of the terminal pin 427 may be fixedly mounted to the second insulator 442.

Connector 400 is a connector configured to be coupled to a coaxial cable. When coupled to a coaxial cable, connector 400 is both mechanically and electrically coupled to a coaxial cable in an interior portion of connector 400. This mechanical and physical connection is imparted by the outer conductor engager 450, which engages the coaxial cable 4. In several embodiments, outer conductor engager 450 is constructed from a conductive material in order to create an electrical connection between the outer conductor 50, the nose cone 432, and the nut 414, which is adapted to connect to a coaxial connector.

For purposes of this disclosure, with reference to the connector 400, a pre-installed or uninstalled state or configuration refers to the connector 400 before it is coupled with the coaxial cable 4 and the interface port 14. A partially-installed/assembled state refers to the connector 400 when it is coupled with the coaxial cable 4, but not with the interface port 14. An installed or fully-installed state refers to the connector 400 when it is coupled with the coaxial cable 4 and the interface port 14.

The outer conductor engager 450 includes a forward flange 452 extending radially outward and configured to electrically engage an inner surface of the nose cone 432. The outer conductor engager 450 defines an aperture 451 for accepting a portion of the coaxial cable 4. The connector 400 may also include a sealing member (not shown), for example, a ring-shaped seal, extending around an outer periphery at a front end of the retainer 420 and being disposed within the nut 414.

The outer conductor engager 450 includes a plurality of resilient fingers 455, separated by longitudinal grooves 453, for engaging a peripheral outer surface of the braided outer conductor 50 of the coaxial cable 4 folded back on the cable jacket. In the described embodiment, each resilient finger 455 includes an inward-facing barb 457 and an outward-facing barb 458 at the rearward end of the outer conductor engager 450, i.e., the end which is distal, or away, from the front end 461 of the outer conductor engager 450. Each resilient finger 455 also includes an outward-facing tapered surface 462 disposed rearward of the outward-facing barb 458.

In the described embodiment, the inward-facing barb 457 is structured and arranged to electrically engage the outer or external peripheral surface of the folded-back braided conductor 50 of the coaxial cable 4 in the partially-installed and fully-installed states. Alternatively, if the braid is folded back, as required by a conventional connector, the inward facing barb 457 can also make contact with the foil. The inward-facing barb 457 also facilitates electrical grounding and retention of the coaxial cable 4 when a radial load displaces a resilient finger 455 against the braided outer conductor 50 of the coaxial cable 4, for example, in the installed state, as discussed in more detail below. It should be appreciated that in alternative embodiments, a radial bore in the outer conductor engager 450 can replace the barb 457. In such an alternative embodiment, the bore is configured to close radially to electrically engage the outer conductor 50.

The connector body 460 defines an aperture 465 for receiving a portion of the coaxial cable 4. The body 460 includes a forward annular ring portion 466 and a rearward annular ring portion 468 configured to engage the compression ring 470. The sleeve 480 surrounds the body 460 in a coaxial relationship. The forward end of the sleeve 480 includes a forward portion with an outward directed lip 481. The forward end of the sleeve 480 is configured to engage an outward lip 463 of the forward annular ring portion 466 of the body 460. The rearward end of the sleeve 480 includes a plurality of fingers 467 separated by longitudinal grooves 469. In some aspects, the body 460 may be metal and the sleeve 480 may be plastic. The engagement feature 440 may engage the outward lip 463 of the body 460 in a first position to resist rearward movement of the body 460 relative to the nose cone 432 and, after the sleeve 480 is moved axially forward, the engagement feature 440 engages the outward lip 481 of the sleeve 480 to resist rearward movement of the sleeve 480 relative to the nose cone 432. The inner surface of the body 460 may be tapered to maintain contact with the folded-back braid of the cable upon assembly.

The fingers of the outer conductor engager 450 engage the outer conductor, e.g., folded-over braid, upon radial compression, while the fingers of the body 460 engage the jacket of the cable upon radial compression. The body 460, for example, a metal body prevents the jacket of the cable from twisting when compressed. Also, a metal body further shields radiation from escaping the connector because the metal body contacts the folded-over braid over an increased length. Meanwhile, the sleeve 480, for example, a plastic sleeve, provides a continuous outer profile because the plastic is radially compressible without fingers. Also, a plastic sleeve requires a lower radial compression force.

The threaded nut 414 includes a threaded portion 413 at its forward end for threadably engaging the threaded outer surface 38 of the interface port 14. A rearward end of the threaded nut 414 is bearing-mounted to the forward flange of the retainer such that the nut 414 is rotatable relative to the nose cone 432, the outer conductor engager 450, the connector body 460, and the sleeve 480.

Figure 8:
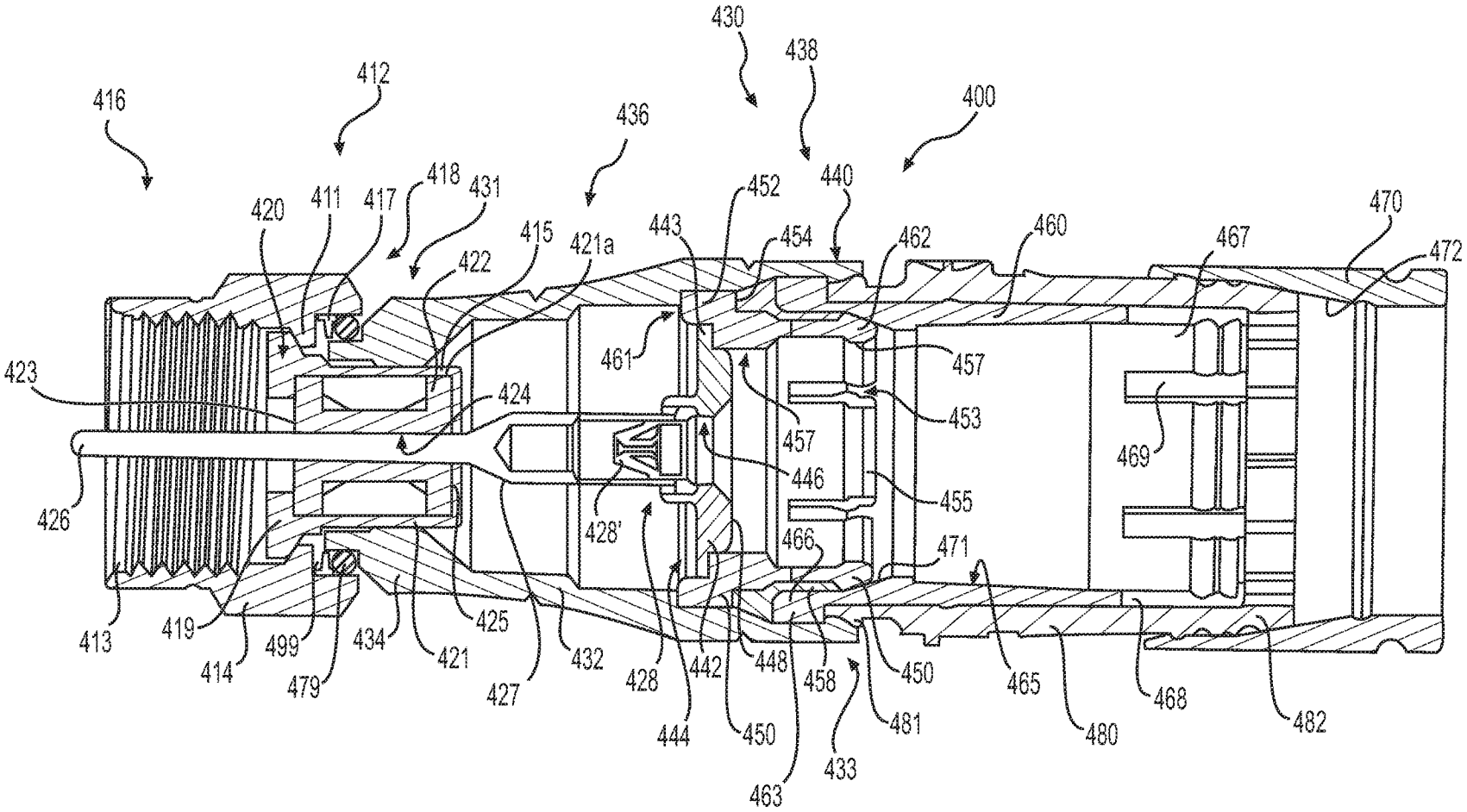
FIG. 8 is a sectional view of the connector of FIG. 7.
Figure 9:
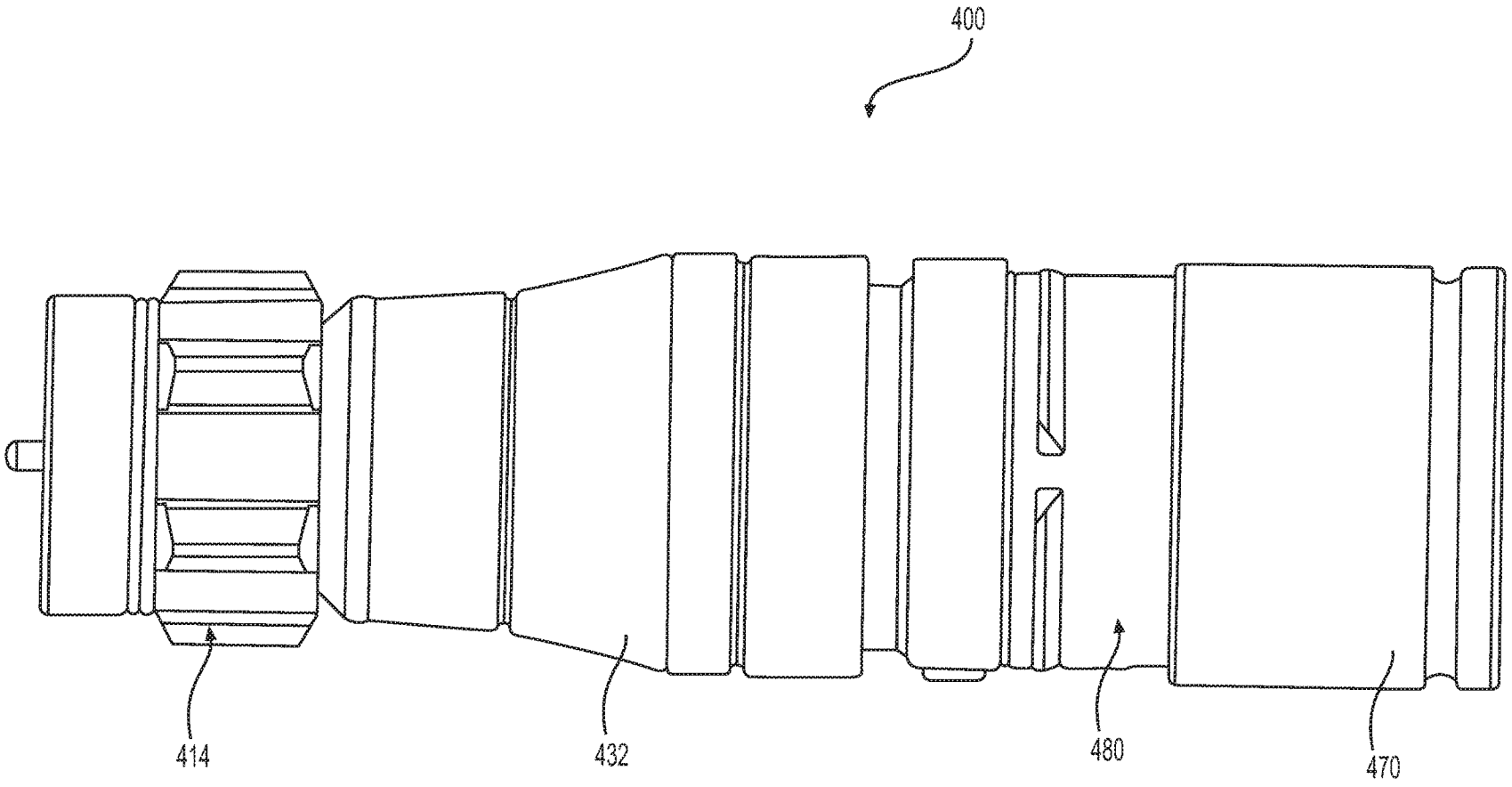
FIG. 9 is a side view of the connector of FIG. 7.
Figure 10:
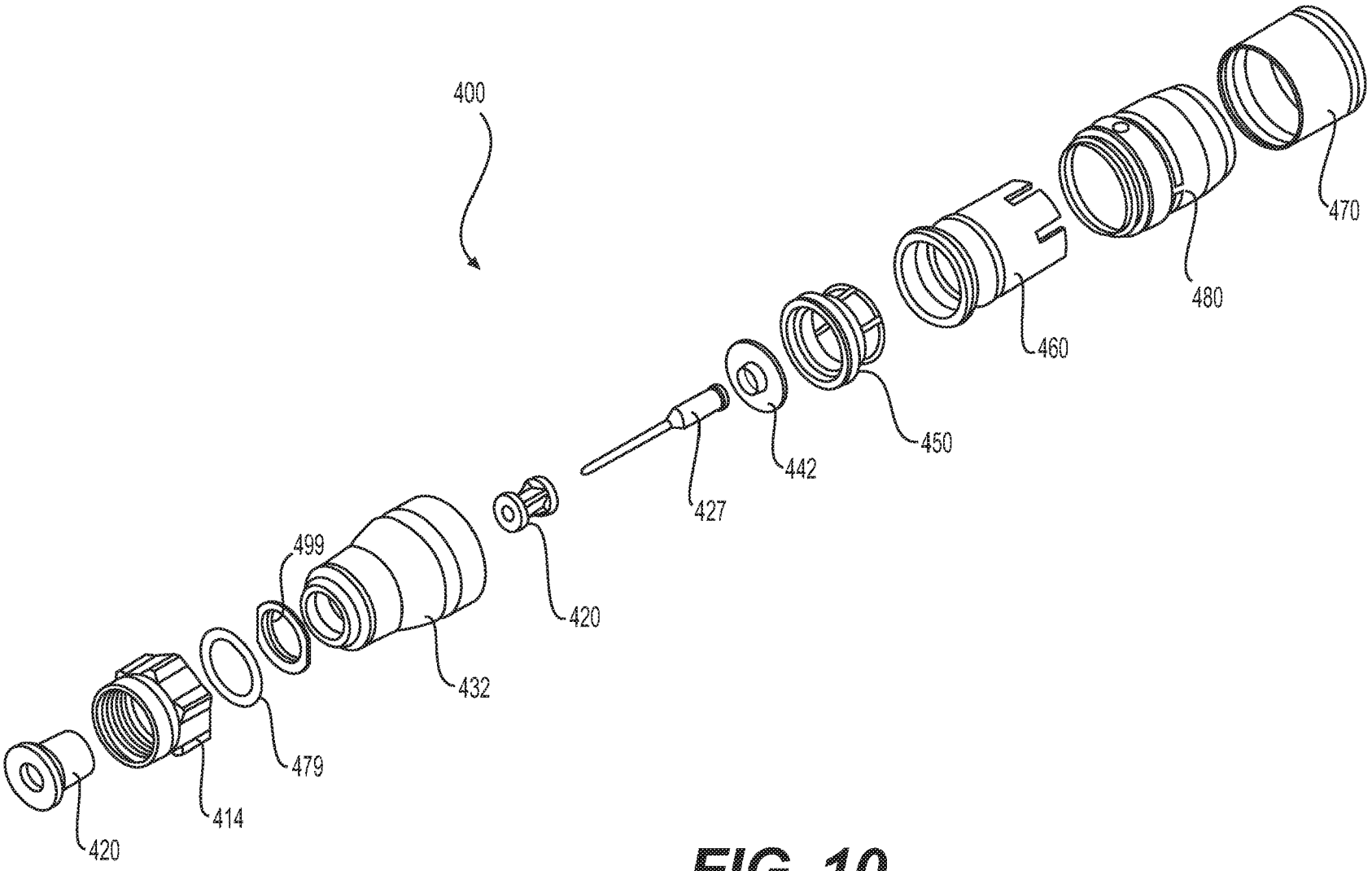
FIG. 10 is an exploded perspective view of the connector of FIG. 7.

Having described the components of the connector 400 in detail, the use of connector 400 in terminating a coaxial cable 4 is now described. Cable 4 is prepared in conventional fashion for termination, as described above. The coaxial cable 4 is inserted into the connector 400, which is arranged as shown in FIG. 8. For example, the inner conductor 44, the insulator 46, and the outer conductor 50 are inserted through the aperture 465 of the body 460 and into the aperture 451 of the outer conductor engager 450. Particularly, the coaxial cable 4 is inserted into the connector 400 and extends through the apertures 451, 465 and extends into the connector end 428 of the terminal pin 427.

The cable 4 may be inserted into connector 400 with the compression sleeve 470 coupled to the rear portion of the connector body 460. Once the cable 4 is properly inserted, the compression sleeve 470 may be moved forward from the first position shown in FIG. 8, to a second position where the compression sleeve 470 is moved axially forward so that a tapered wall 472 of the compression sleeve 470 rides over the rear portion 482 of the sleeve 480. A suitable tool may be used to effect movement of compression sleeve 470 from its first position in FIG. 8 to a second position securing the cable 4 to the connector body 460. The tool may also include a plunger configured to move the first insulator 422 rearwardly such that the rear end of the terminal pin 427 is urged further into the second insulator 442 and onto the center conductor 44 of the cable 4.

In some embodiments, the force required for the compression sleeve 470 to ride over the rear portion 482 of the sleeve 480 and radially compress the fingers 467 is greater than the force required for the outward lip 481 of the sleeve 480 to move forward past the engagement feature 440 of the nose cone 432 and compress the fingers 455 of the outer conductor engager 450. Thus, as the compression sleeve 470 is urged to move forwardly, the sleeve 480 and the connector body 460 are first moved axially forward relative to the outer conductor engager 450 to a second position where a forward facing surface of the forward annular ring portion 466 engages a rearward facing shoulder 454 of the outer conductor engager 450. In the second position, the relative axial movement between the connector body 460 and the outer conductor engager 450 causes the fingers 455 to be radially compressed by a tapered inner surface 471 of the connector body 460 the onto the shield 50 of the cable to provide electrical grounding therebetween. Then, the compression sleeve 470 then rides over the rear portion 482 of the sleeve 480 and the tapered wall 472 of the compression sleeve 470 radially compresses the fingers 467 against the jacket 52 of the cable 4. That is, the jacket 52 and the shield 50 of the cable 4 become compressively clamped within annular region of the connector body 460 by radial compression of the fingers 467 of the body 460. The outer surface of the sleeve 480 may include an engagement feature, such as ridge 483, which is configured to engage an engagement feature 484 of the compression sleeve 470 when the compression sleeve 470 reaches a desired axial position relative to the sleeve 480. The engagement feature 484 may be, for example, an radially inward annular lip at a forward end of the compression sleeve 470. Engagement of the engagement features 483, 484 resists rearward axial movement of the compression sleeve 470 relative to the sleeve 480.

During installation of the connector 400 to an interface port 14, the nut 414 threadably engages the interface port 14. As the nut 414 is fastened to the interface port 14, for example, by rotating the nut 414 relative to the interface port 14, the interface port 14 is drawn toward the of the retainer. The free end of the interface port 14 has a sloped edge configured such that as the nut 414 is tightened on the interface port 14, the sealing member 490 is expanded radially outward and compressed in the radially outward direction against the recess surface located in the nut 414 to provide a weatherproof seal therebetween. When fully tightened, the front surface of the flange will make direct contact with the interface port 14.

The embodiment of the present disclosure provides an apparatus and method for producing a reliable electrical ground, a secure mechanical connection, and a plurality of watertight seals to protect a coaxial cable connector. The apparatus and method eliminates the need to fold the outer conductor over the compliant outer jacket 52 of the coaxial cable 4. Connector 400 has the advantage of being easier to attach to the cable, because it is easier and requires less force to compress engager 450 to outer conductor 50, than to insert a post between outer conductor 50 and jacket 52, and subsequently crimp the connector.

Figure 11:
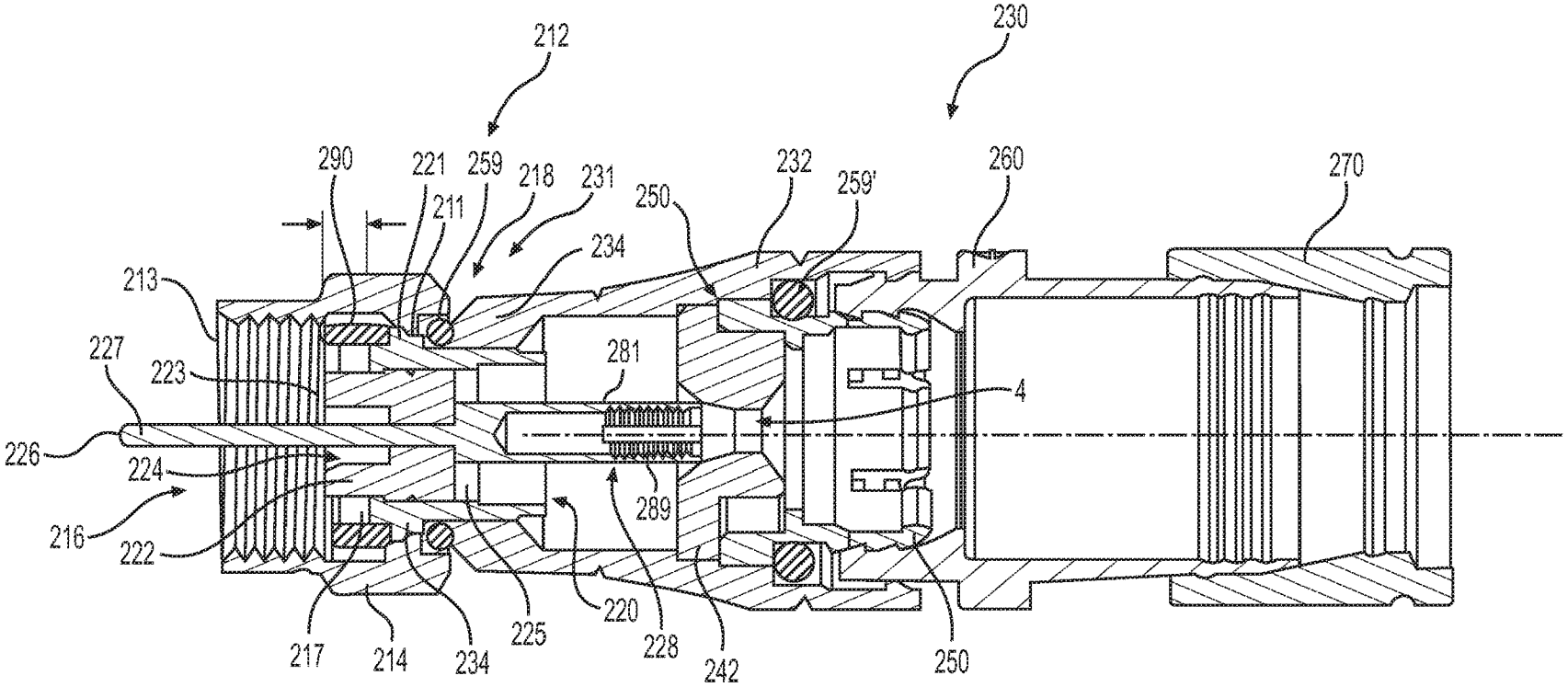
FIG. 11 is a sectional view of an exemplary connector in accordance with various aspects of the disclosure.
Figure 12:
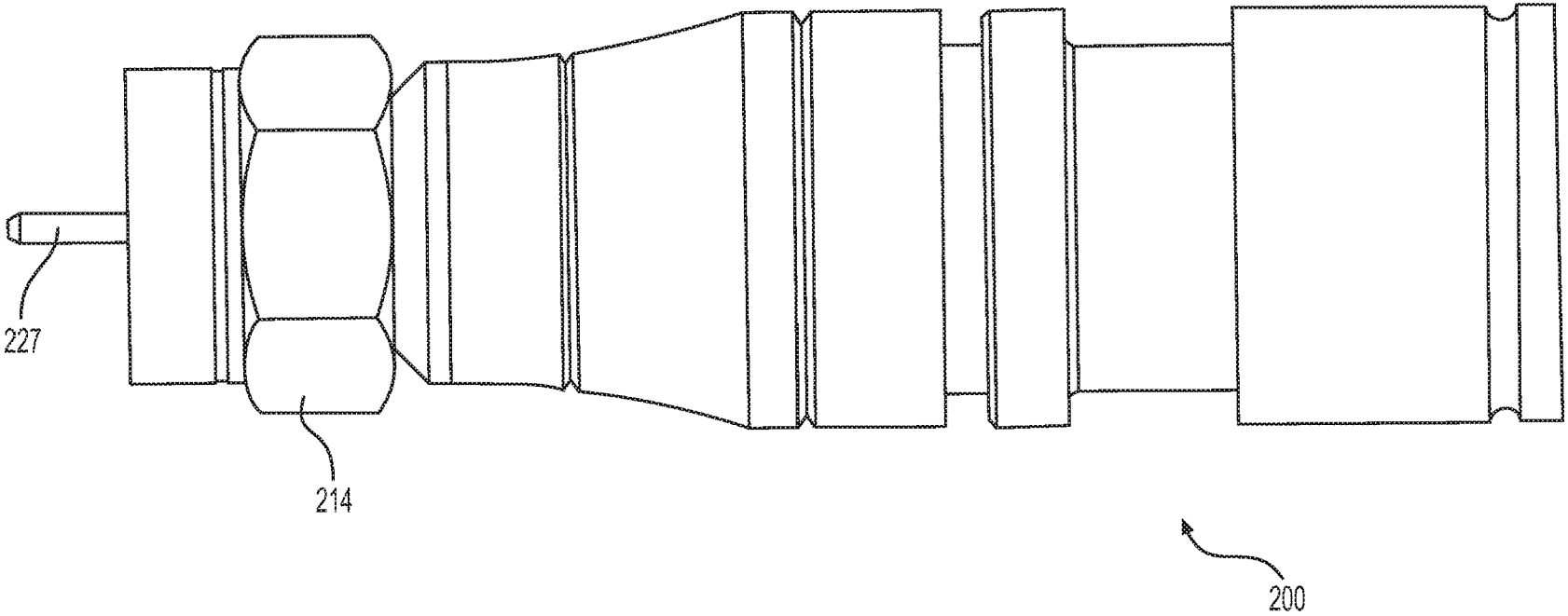
FIG. 12 is a side view of the connector of FIG. 11.
Figure 13:
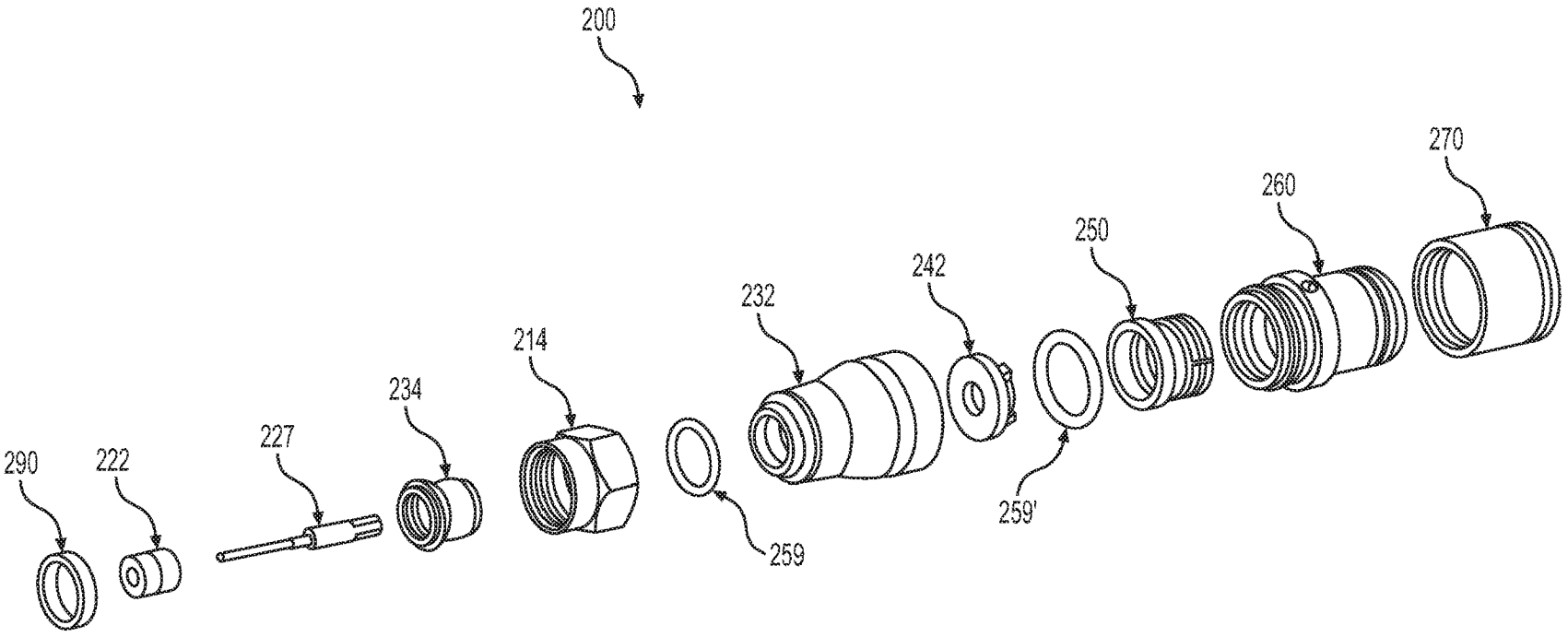
FIG. 13 is an exploded perspective view of the connector of FIG. 11.

According to the disclosure, the aforementioned connectors 2 may be configured as coaxial cable connector 200, as illustrated in FIGS. 11-13. When the connector 200 is installed on an interface port 14, a forward end, portion, or direction is proximal to, or toward, the interface port 14, and a rearward end, portion, or direction is distal, or away, from the interface port 14.

Referring now to FIGS. 11-13, an embodiment of a connector 200, which may be formed by a nut sub-assembly 212 and a housing sub-assembly 230, is illustrated. The nut sub-assembly 212 includes a nut 214, a retainer 220, a first insulator 222, and a terminal pin 227. The nut 214 has a threaded interior 213 at a first forward end 216 for connection to a termination device (e.g., an interface port) and a recessed opening 217 (see FIG. 12) at a second rearward end 218 for receiving a collar 234 of the housing assembly 230. The nut 214 also has a lip 211 between the first and second ends 216, 218, which extends radially inward from the axial bore and reduces the inner diameter of the axial bore. The retainer 220 is cylindrically shaped and has a radially outer rim 219 on the first end, a plain second end 221 and an axial bore 215 between the two ends. When the retainer 220 is inserted into the nut 214, the rim 221 on the retainer 220 contacts the lip 211, which prevents further passage of the retainer 220 through the axial bore of the nut 214. The first insulator 222 has a first end 223, a second end 225, and an aperture 224 along the axis between the two ends 223, 225.

The nut sub-assembly 212 also includes a terminal pin 227, which is secured in the nut 214 by the first insulator 222 and the retainer 220. The terminal pin 227 has a solid pin end 226 for connecting to an electrical device (not shown) and a connector end 228 for receiving the center conductor 44 of a coaxial cable 4. The connector end 228 has a cylindrically-shaped wall 229 and can have one or more slots 281 and/or a plurality of circumferential grooves 283 on the interior surface of the wall 229, which facilitate compressing the connector end 228 and engaging the center conductor 44 of a coaxial cable 4. The solid pin end 226 is inserted into the aperture 224 in the first insulator 222 and is snugly secured in the first insulator 222. The solid pin end 226 and insulator 222 are secured in the nut 214 by the retainer 220, which is inserted into the nut 214 from the first end 216. The solid pin end 226 of the terminal pin 227 passes through the retainer 220 and extends beyond the first end 216 of the nut 214.

The housing sub-assembly 230 includes a nose cone 232, or forward body portion, that has a collar 234 on a first end 231 and a latching feature 240 on a second end 233. The nose cone 232 receives, in sequential order, a second retainer 242, an outer conductor engager 250, an O-ring 259, a body 260, and a compression ring 270. The nose cone 232 is substantially cylindrical in shape and has a first section 236, a second section 238, and an axial bore that extends between a first end 231 and a second end 233. An O-ring 279 is fitted over the outer perimeter of the collar 234 of the nose cone 232.

The second end 233 of the nose cone 232 receives a coaxial cable 4 having a center conductor 44 and an outer conductor 50. The connection between the terminal pin 27 and the center conductor 44 of the coaxial cable 4 is made in the first section 236 of the nose cone 232 and the coaxial cable 4 is secured in the second section 238 of the nose cone 232. When the nut sub-assembly 212 and the housing sub-assembly 230 are assembled, the second end 221 of the retainer 220 passes through the first end 216 of the nut 214 and is inserted into the collar 234 at the first end 231 of the nose cone 232. A flaring tool is then inserted into the second end 233 of the nose cone 232 and is used to flare a second end 221*a* of the retainer 220 outwardly, which secures the retainer 220 relative to the collar 234 of the nose cone 232. The O-ring 279 on the outside of the collar 234 forms a seal between the collar 234 and the nut 214. The solid pin end 226 of the terminal pin 227 (secured in the first insulator 222) is then passed through the second end 233 of the nose cone 232 and inserted in the retainer 220. The ends 223, 225 of the first insulator 222 snugly contact the interior wall of the axial bore 215 of the retainer 220 and secure the first insulator 222 and the terminal pin 227 in the retainer 220.

The second retainer 242 has a blank flange 243 at a first end 144, a plain second end 248, and an axial bore between the flange 243 at the first end 244 and the second end 248. The second retainer 242 has an aperture 246 that is sized to accommodate the center conductor 44 of the coaxial cable 4. The outside diameter of the flange 243 is sized so that it can pass through the second section 238 of the nose cone 232 and press fit snugly against the interior wall of the first section 236.

Connector 200 is a connector configured to be coupled to a coaxial cable. When coupled to a coaxial cable, connector 200 is both mechanically and electrically coupled to a coaxial cable in an interior portion of connector 200. This mechanical and physical connection is imparted by the outer conductor engager 250, which engages the coaxial cable 4. In several embodiments, outer conductor engager 250 is constructed from a conductive material in order to create an electrical connection between the outer conductor 50, the nose cone 232, and the nut 214, which is adapted to connect to a male coaxial connector.

For purposes of this disclosure, with reference to the connector 200, a pre-installed or uninstalled state or configuration refers to the connector 200 before it is coupled with the coaxial cable 4 and the interface port 14. A partially-installed/assembled state refers to the connector 200 when it is coupled with the coaxial cable 4, but not with the interface port 14. An installed or fully-installed state refers to the connector 200 when it is coupled with the coaxial cable 4 and the interface port 14.

The outer conductor engager 250 includes a forward flange 252 extending radially outward and configured to electrically engage an inner surface of the nose cone 232. A rearward flange 254 also defines a rearward-facing stop surface 256 for engaging an edge of a coaxial cable 4. The outer conductor engager 250 defines an aperture 251 for accepting a portion of the coaxial cable 4. The connector 200 also includes a sealing member 290, for example, a ring-shaped seal, extending around an outer periphery at a front end of the retainer and being disposed within the nut 214.

The outer conductor engager 250 includes a plurality of resilient fingers 255 for engaging a peripheral outer surface of the braided outer conductor 50 of the coaxial cable 4. In the described embodiment, each resilient finger 255 includes an inward-facing barb 257 and a first outward-facing barb 258 at the rearward end of the outer conductor engager 250, i.e., the end which is distal, or away, from the front end 261 of the outer conductor engager 250. Each resilient finger 255 also includes an outward-facing tapered surface 262 disposed rearward of the first outward-facing barb 258 and at least one second outward-facing barb 264, 264' disposed forward of the first outward-facing barb 258.

In the described embodiment, the inward-facing barb 257 is structured and arranged to electrically engage the outer or external peripheral surface of the braided conductor 50 of the coaxial cable 4 in the partially-installed and fully-installed states. Alternatively, if the braid is folded back, as required by a conventional connector, the inward facing barb 257 can also make contact with the foil. The inward-facing barb 257 also facilitates electrical grounding and retention of the coaxial cable 4 when a radial load displaces a resilient finger 255 against the braided outer conductor 50 of the coaxial cable 4, for example, in the installed state, as discussed in more detail below. It should be appreciated that in alternative embodiments, a radial bore in the outer conductor engager 250 can replace the barb 257. In such an alternative embodiment, the bore is configured to close radially to electrically engage the outer conductor 50.

The connector body 260 defines an aperture 265 for receiving a portion of the coaxial cable 4. The body 260 includes a forward annular ring portion 266 and a rearward annular ring portion 268 configured to engage the compression ring 270.

The threaded nut 214 includes a threaded portion at its forward end for threadably engaging the threaded outer surface 38 of the interface port 14. A rearward end of the threaded nut 214 is bearing-mounted to the forward flange of the retainer such that the nut 214 is rotatable relative to the nose cone 232, the outer conductor engager 250, and the connector body 260.

Having described the components of the connector 200 in detail, the use of connector 200 in terminating a coaxial cable 4 is now described. Cable 4 is prepared in conventional fashion for termination, as described above.

As shown in FIG. 11, when the connector is in the pre-installed state, the body 260 includes a first lip 269 rearward of the first outward-facing barb 258 of each resilient finger 255. A second lip 271 of the body 260 is disposed axially between the first outward-facing barb 258 and the second outward-facing barb 264 of each resilient finger 255. The forward annular ring portion 266 may include a third biasing element 272 disposed axially between the second outward-facing barbs 264, 264' of each resilient finger 255.

In the partially-installed state, the coaxial cable 4 is inserted into the connector 200. For example, the inner conductor 44, the insulator 46, and the outer conductor 50 are inserted through the aperture 265 of the body 260 and into the aperture 251 of the outer conductor engager 250. Particularly, the coaxial cable 4 is inserted into the connector 200 until the forward stop surface along the outer jacket 52 of the coaxial cable 4 abuts a rearward-facing stop surface of the first lip 269 of the body 260 and the forward edge surface of the insulator 46 and outer conductor 50 abut the rearward-facing stop surface of the outer conductor engager 250. The inner conductor 44 extends through the apertures 251, 265 and extends into the rear end of the terminal pin 227.

The cable 4 may be inserted into connector 200 with the compression sleeve 270 coupled to the rear portion of the connector body 260. Once the cable 4 is properly inserted, the compression sleeve 270 may be moved forward from the first position shown in FIG. 11, to a second position where the compression sleeve 270 is moved axially forward so that a tapered wall 272 of the compression sleeve 270 rides over the rear portion of the connector body 260. A suitable tool may be used to effect movement of compression sleeve 270 from its first position to its second position securing the cable 4 to the connector body 260. The tool may also include a plunger configured to move the first insulator rearwardly such that the rear end of the terminal pin in urged further into the second insulator and onto the center conductor 44 of the cable 4.

As the compression sleeve 270 is urged to move forwardly, the connector body 260 is first moved axially forward relative to the outer conductor engager 250 because of the resiliency of the fingers 252 of the outer conductor engager 250. In other words, the force required to compress the fingers 252 and effect axial movement of the connector body 250 relative to the outer conductor engager 252 is less than the force required to compress the connector body 260 to permit axial movement of the compression ring 270 relative to the connector body 260.

The connector body 260 then continues to move relative to the outer conductor engager 252 to a final position where the third lip 273 is axially forward of the second barb 264', the second lip 271 is between the second barbs 264, 264', and the first lip 269 is between the first barb 258 and the second barb 264. Also, the first lip 269 projects radially inward such that the relative axial movement between the connector body 260 and the outer conductor engager 250 causes the fingers 252 to be compressed by the first lip 269 onto the shield 50 of the cable to provide electrical grounding therebetween in the pre-installed/assembled state.

Also, when the connector body 260 reaches the final position relative to the outer conductor engager 250 and the nose cone 232, the compression sleeve 270 then begins to move axially relative to the connector body 260 towards a second position. In this second position, the jacket 52 and the shield 50 of the cable 4 begin to become compressively clamped within annular region of the connector body 260. Such second position is achieved as an inward barb 285 of the compression sleeve 270 resiliently rides over a rib 286 on the outer surface of the connector body 260. In that regard, the inward barb 285 engages the rib 286 to maintain compression sleeve 270 in the second position with respect to connector body 260. The connector body 260 includes an radially-outward projection that provides a stop shoulder to limit forward movement of the compression sleeve 270 relative to the connector body 260.

During installation of the connector 200 to an interface port 14, the nut 214 threadably engages the interface port 14. As the nut 214 is fastened to the interface port 14, for example, by rotating the nut 214 relative to the interface port 14, the interface port 14 is drawn toward the of the retainer. The free end of the interface port 14 has a sloped edge configured such that as the nut 214 is tightened on the interface port 14, the sealing member 290 is expanded radially outward and compressed in the radially outward direction against the recess surface located in the nut 214 to provide a weatherproof seal therebetween. When fully tightened, the front surface of the flange will make direct contact with the interface port 14.

The embodiment of the present disclosure provides an apparatus and method for producing a reliable electrical ground, a secure mechanical connection, and a plurality of watertight seals to protect a coaxial cable connector. The apparatus and method eliminates the need to fold the outer conductor over the compliant outer jacket 52 of the coaxial cable 4. Connector 200 has the advantage of being easier to attach to the cable, because it is easier and requires less force to compress engager 250 to outer conductor 50, than to insert a post between outer conductor 50 and jacket 52, and subsequently crimp the connector.

Figure 14:
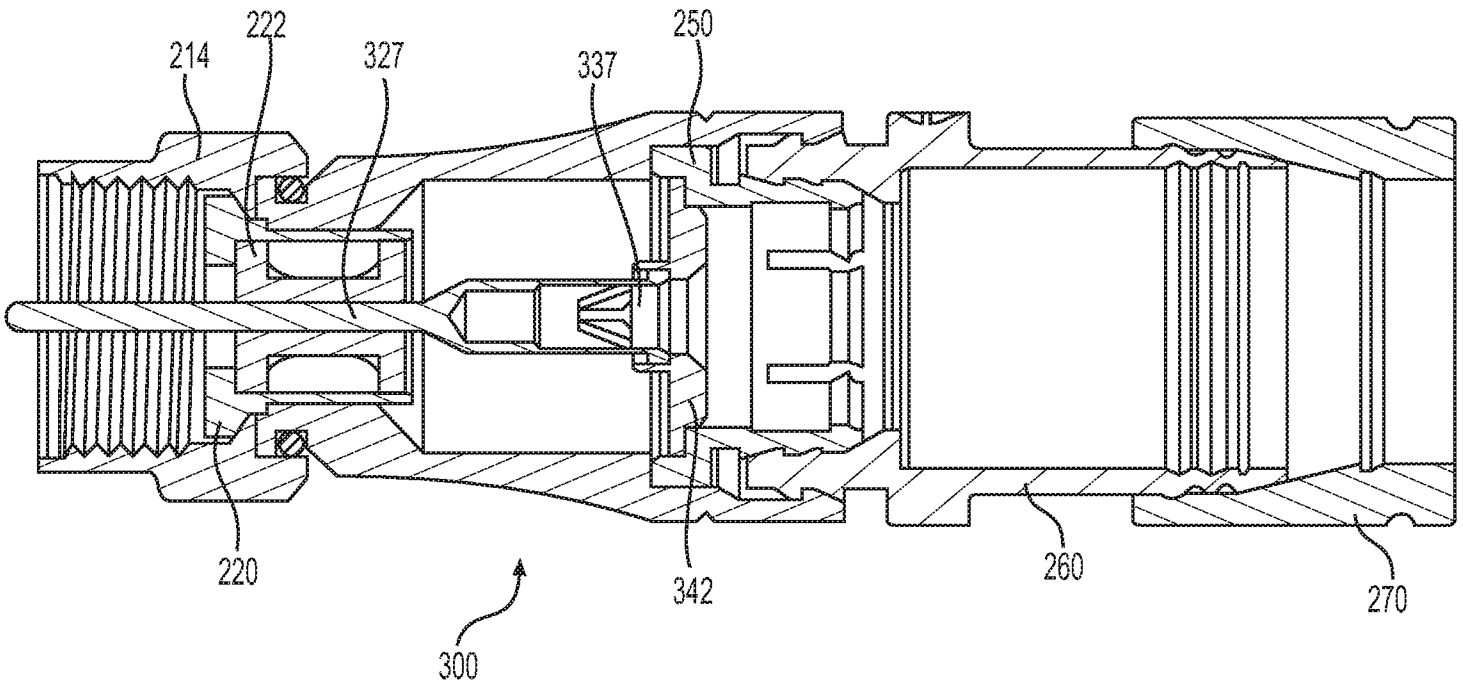
FIG. 14 is a side view of an exemplary connector in accordance with various aspects of the disclosure.
Figure 15:
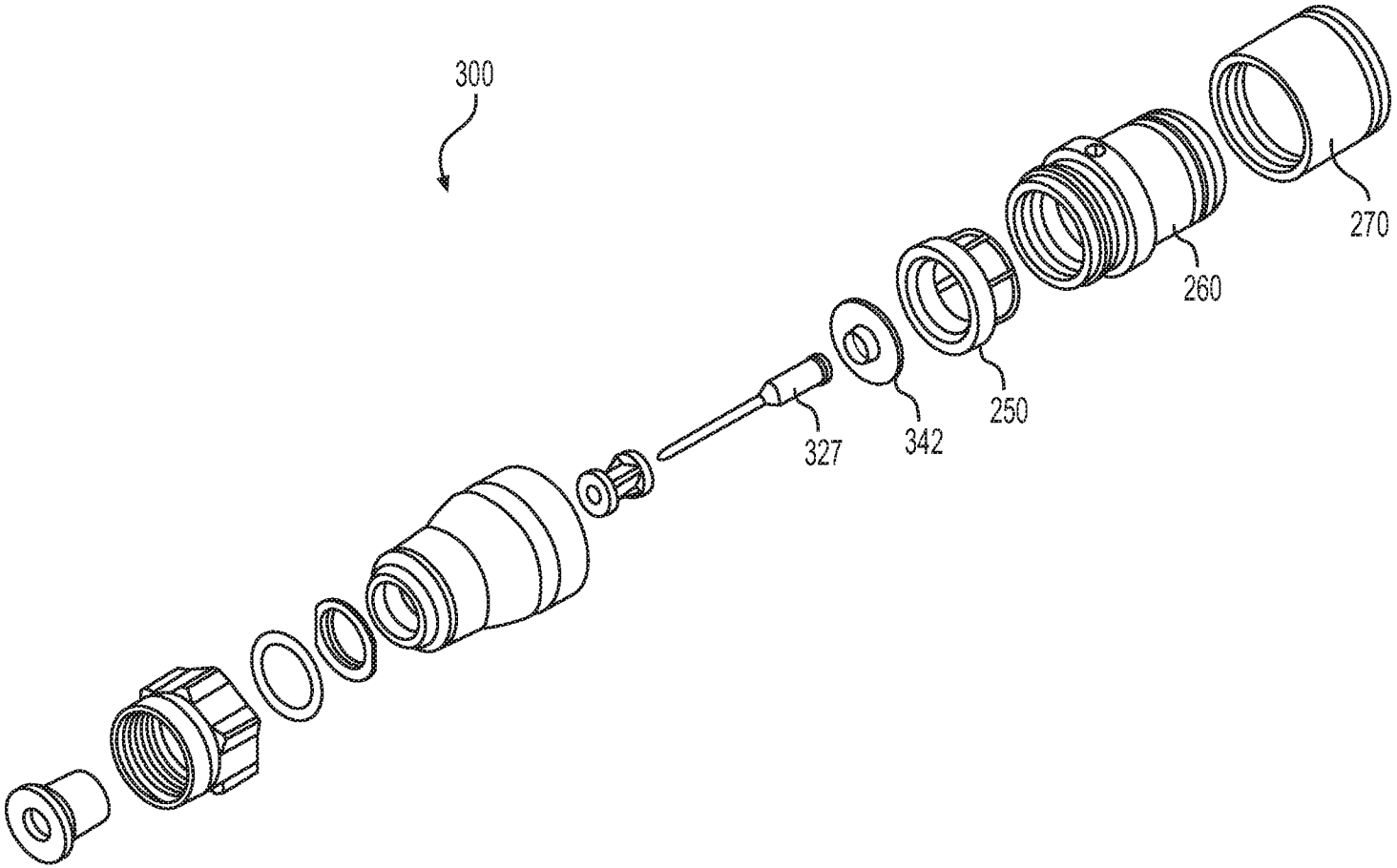
FIG. 15 is an exploded perspective view of the connector of FIG. 14.

Referring now to FIGS. 14 and 15, according to another embodiment, a connector according to the present disclosure is similar to the connector illustrated in and described with respect to FIGS. 11-13. However, the terminal pin 327 includes a Milmax-type connector 337 at its rearward end to securely grip the center conductor 44 of a cable 4. Also, the rearward end of the terminal pin is fixedly mounted to the second insulator 342.

Figure 16:
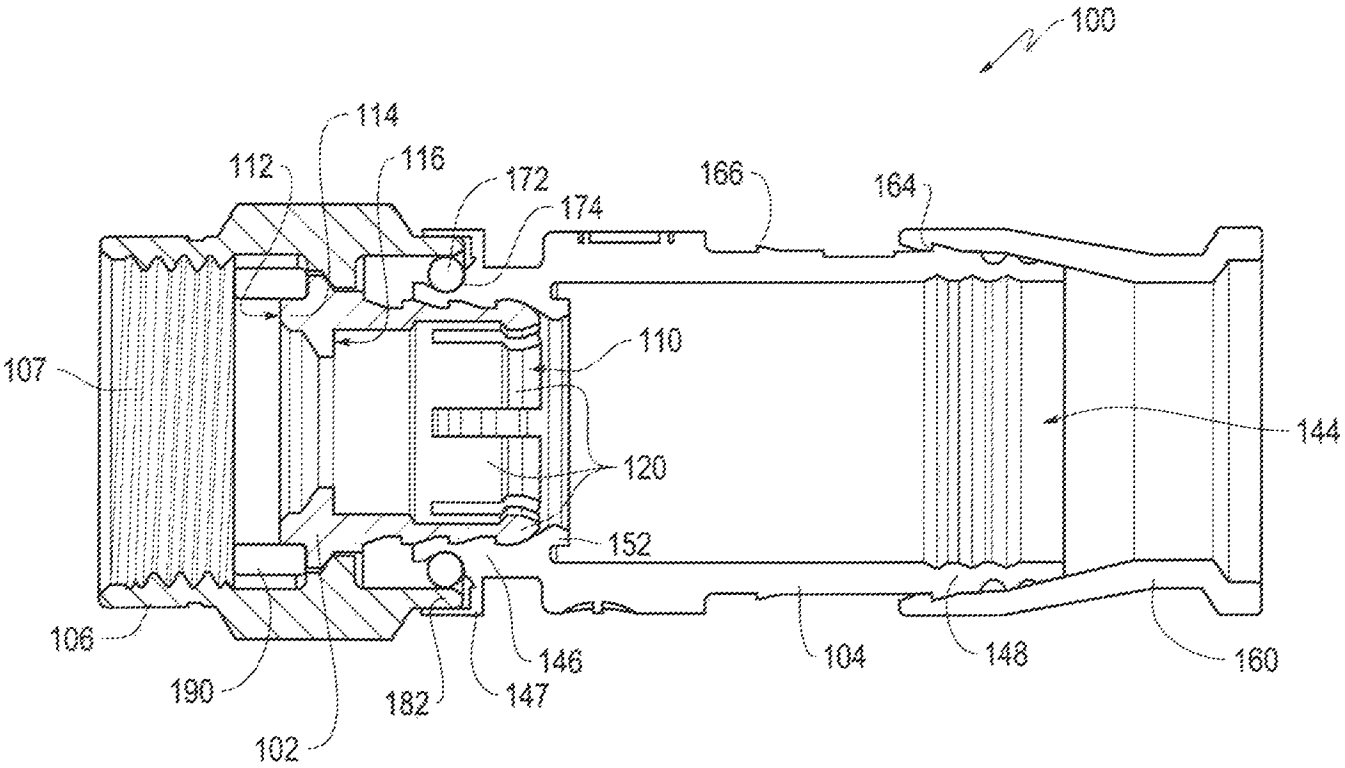
FIG. 16 is a sectional view of an exemplary connector disposed in accordance with various aspects of the disclosure.
Figure 17:
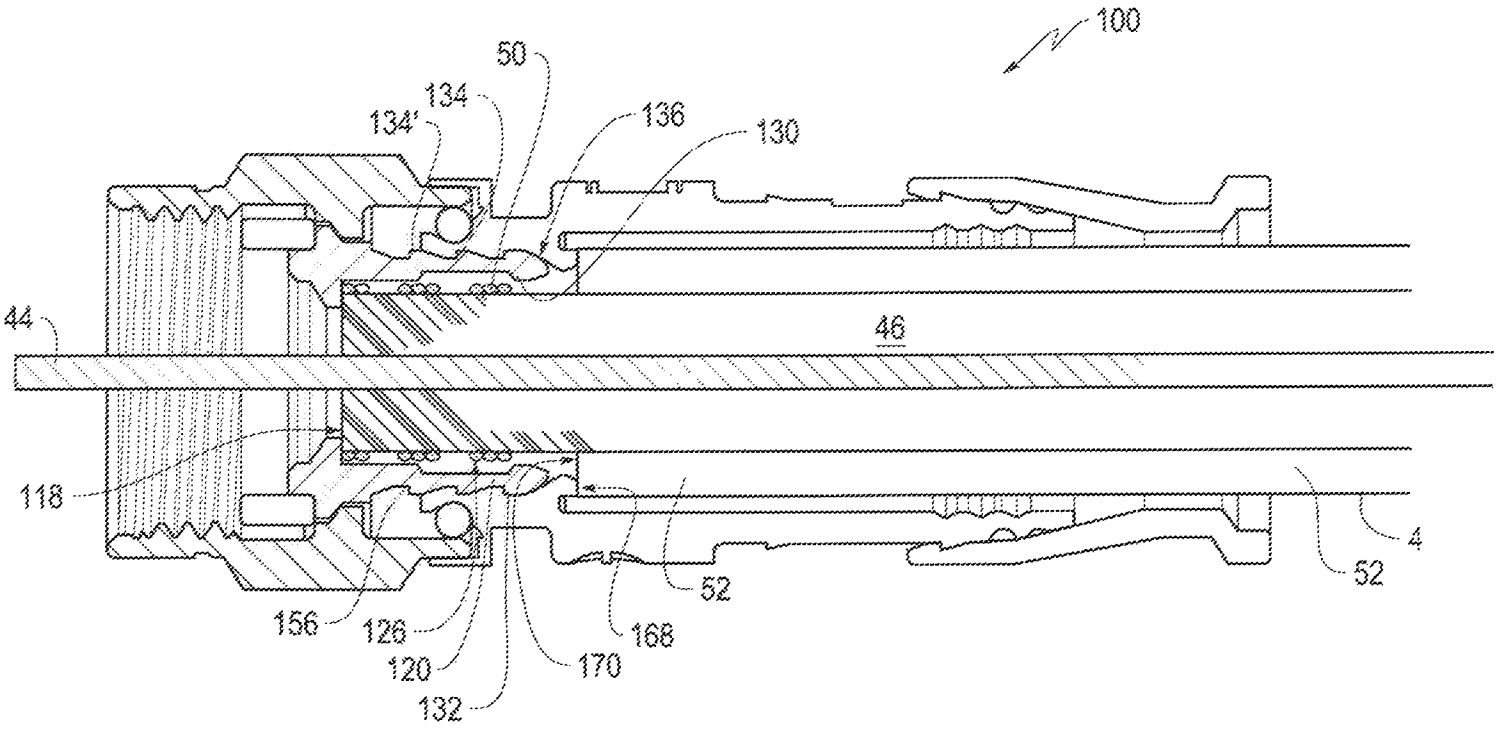
FIG. 17 is a sectional view of the outer conductor engager of the connector of FIG. 16 disposed in combination with a prepared end of a coaxial cable in a pre-engaged condition.
Figure 18:
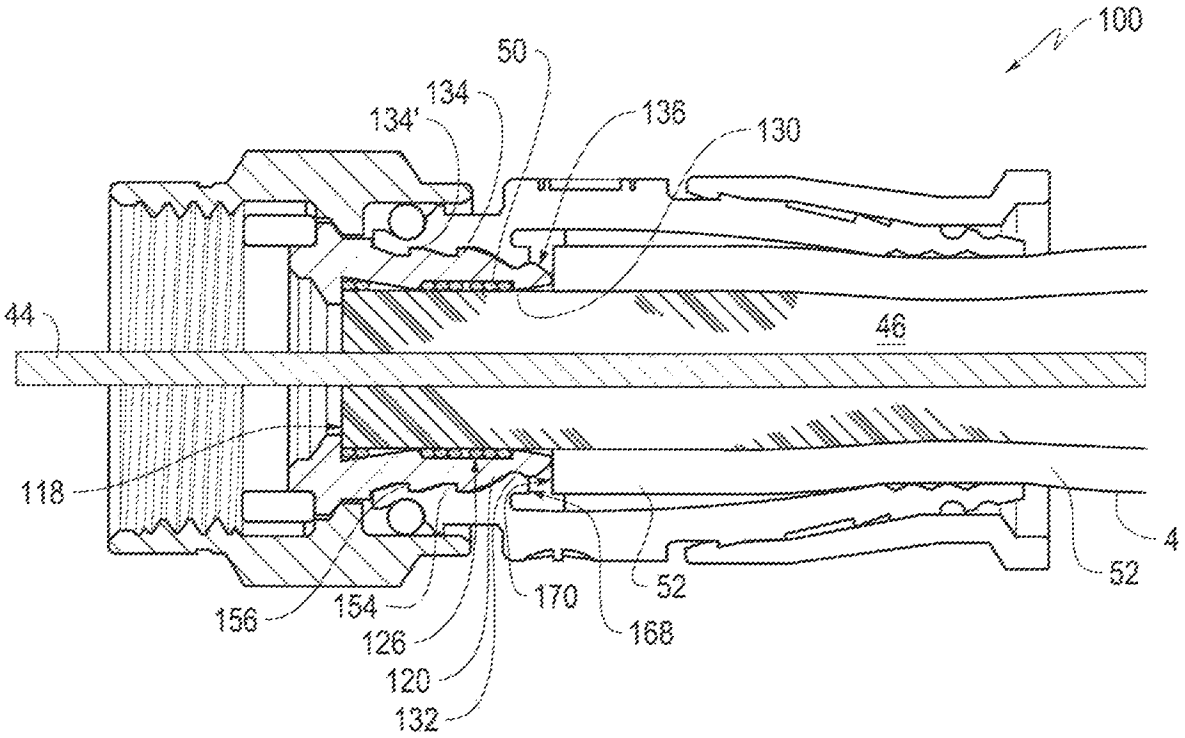
FIG. 18 is a sectional view of the cable and connector of FIG. 16 in an engaged condition.

According to some aspects of the disclosure, the aforementioned connectors 2 may be configured as coaxial cable connector 100, as illustrated in FIGS. 16-18. When the connector 100 is installed on an interface port 14, a forward end, portion, or direction is proximal to, or toward, the interface port 14, and a rearward end, portion, or direction is distal, or away, from the interface port 14.

Connector 100 is a connector configured to be coupled to a coaxial cable. When coupled to a coaxial cable, connector 100 is both mechanically and electrically coupled to a coaxial cable in an interior portion of connector 100. This mechanical and physical connection is imparted by post (i.e. engager) 102, which engages the coaxial cable. In several embodiments, post 102 is constructed from a conductive material in order to create an electrical connection between the outer conductor 50 and threaded coupler (i.e. nut) 106, which is adapted to connect to a male coaxial connector.

For purposes of this disclosure, with reference to the connector 100, a pre-installed or uninstalled state or configuration refers to the connector 100 before it is coupled with the coaxial cable 4 and the interface port 14. A partially-installed/assembled state refers to the connector 100 when it is coupled with the coaxial cable 4, but not with the interface port 14. An installed or fully-installed state refers to the connector 100 when it is coupled with the coaxial cable 4 and the interface port 14.

Referring now to FIGS. 16-18, the coaxial cable connector 100 includes an outer conductor engager or post 102, a connector body or housing 104, and a threaded coupler 106. The outer conductor engager 102 includes a forward flange 114 having a forward-facing front face surface 112 for electrically engaging a face surface of an interface port 14 (described in more detail below). The flange 114 also defines a rearward-facing stop surface 116 for engaging an edge 118 of a coaxial cable 4. The outer conductor engager 102 defines an aperture 110 for accepting a portion of the coaxial cable 4. The connector 100 also includes a sealing member 190, for example, a ring-shaped seal, extending around an outer periphery of the flange 114 and being disposed within the threaded coupler 106.

The outer conductor engager 102 includes a plurality of resilient fingers 120 for engaging a peripheral outer surface 126 of the braided outer conductor 50 of the coaxial cable 4. In the described embodiment, each resilient finger 120 includes an inward-facing barb 130 and a first outward-facing barb 132 at the rearward end of the outer conductor engager 102, i.e., the end which is distal, or away, from the front face surface 112 of the outer conductor engager 102. Each resilient finger 120 also includes an outward-facing tapered surface 136 disposed rearward of the first outward-facing barb 132 and at least one second outward-facing barb 134, 134' disposed forward of the first outward-facing barb 132.

In the described embodiment, the inward-facing barbs 130 are structured and arranged to electrically engage the outer or external peripheral surface 126 of the braided conductor 50 of the coaxial cable 4 in the partially-installed and fully-installed states. Alternatively, if the braid is folded back, as required by a conventional connector, the inward facing barbs 130 can also make contact with the foil. The inward-facing barbs 130 also facilitate electrical grounding and retention of the coaxial cable 4 when a radial load displaces a resilient finger 120 against the braided outer conductor 50 of the coaxial cable 4, for example, in the installed state, as discussed in more detail below. It should be appreciated that in alternative embodiments, a radial bore in the outer conductor engager 102 can replace the barbs 130. In such an alternative embodiment, the bore is configured to close radially to electrically engage the outer conductor 50.

The connector body 104 defines an aperture 144 for receiving a portion of the coaxial cable 4. The body 104 includes a forward annular ring portion 146, a breakaway body 147 extending radially outward from the forward annular ring portion 146, and a rearward annular ring portion 148 configured to engage a compression ring 160.

The threaded coupler 106 includes a threaded portion 107 at its forward end for threadably engaging the threaded outer surface 38 of the interface port 14. A rearward end of the threaded coupler 106 is bearing-mounted to the forward flange 114 of the outer conductor engager 102 such that the coupler 106 is rotatable relative to the outer conductor engager 102 and the connector body 104.

Having described the components of the connector 100 in detail, the use of connector 100 in terminating a coaxial cable 4 is now described. Cable 4 is prepared in conventional fashion for termination, as described above.

As shown in FIGS. 16-18, when the connector is in the pre-installed state, the first biasing element 152 of the body 104 is rearward of the first outward-facing barb 132 of each resilient finger 120. A second biasing element 154 of the body 104 is disposed axially between the first outward-facing barb 132 and the second outward-facing barb 134 of each resilient finger 120. The forward annular ring portion 146 may include a third biasing element 156 disposed axially between the second outward-facing barbs 134, 134' of each resilient finger 120.

In the partially-installed state, the coaxial cable 4 is inserted into the connector 100, as shown in FIG. 17. For example, the inner conductor 44, the insulator 46, and the outer conductor 50 are inserted through the aperture 144 of the body 104 and into the aperture 110 of the outer conductor engager 102. Particularly, the coaxial cable 4 is inserted into the connector 100 until the forward stop surface 170 along the outer jacket 52 of the coaxial cable 4 abuts a rearward-facing stop surface 168 of the first biasing element 152 of the body 104 and the forward edge surface 118 of the insulator 46 and outer conductor 50 abut the rearward-facing stop surface 116 of the outer conductor engager 102. The inner conductor 44 extends through the apertures 110, 144 and extends beyond the front face surface 112 of the outer conductor engager 102.

As shown in FIG. 17, the cable 4 may be inserted into connector 100 with the compression sleeve 160 coupled to the rear portion 148 of the connector body 104. Once the cable 4 is properly inserted, the compression sleeve 160 may be moved forward from the first position shown in FIG. 17, to a second position shown in FIG. 18, where the compression sleeve 160 is moved axially forward so that a tapered wall 162 of the compression sleeve rides over the rear portion 148 of the connector body 104. A suitable tool may be used to effect movement of compression sleeve 160 from its first position to its second position securing the cable 4 to the connector body 104.

As the compression sleeve 160 is urged to move forwardly, the connector body 104 is first moved axially forward relative to the outer conductor engager 102 because of the resiliency of the fingers 120 of the outer conductor engager 102. In other words, the force required to compress the fingers 120 and effect axial movement of the connector body 104 relative to the outer conductor engager 102 is less than the force required to compress the connector body 104 to permit axial movement of the compression ring 160 relative to the connector body 104.

As the connector body 104 is moved relative to the outer conductor engager 102, the rearward flange 182 of the outer conductor engager 102 engages the breakaway body 147 extending from the forward portion 146 of the connector body 104. Continued movement of the connector body 104 relative to the outer conductor engager 102 cause the breakaway body 147 to bend rearward and eventually break apart from the connector body 104. The connector body 104 then continues to move relative to the outer conductor engager 102 to a final position where the third lip 156 is axially forward of the second barb 134', the second lip 154 is between the second barbs 134, 134', and the first lip 152 is between the first barb 132 and the second barb 134. Throughout the movement of the connector body 104 relative to the outer conductor engager 102, the sealing member 172 remains correctly positioned between the coupling member 106 and the notch 174 on the outer surface of the front portion 146 of the connector body 104. In this embodiment, sealing member 172 is ring-shaped to facilitate easier movement between coupling member 106 and connector body 104. When the connector body 104 reaches the final position relative to the outer conductor engager 102, the sealing member 172 provides a watertight seal between the coupler 106 and the connector body 104. Also, the first lip 152 projected radially inward such that the relative axial movement between the connector body 104 and the outer conductor engager 102 causes the fingers 120 to be compressed by the first lip 152 onto the shield 50 of the cable to provide electrical continuity therebetween in the pre-installed/assembled state.

Also, when the connector body 104 reaches the final position relative to the outer conductor engager 102, the compression sleeve 160 then begin to move axially relative to the connector body 104 to the second position shown in FIG. 18. In this second position, the jacket 52 and the shield 50 of the cable 4 begin to become compressively clamped within annular region 144 of the connector body. Such second position is achieved as an inward barb 164 of the compression sleeve 160 resiliently rides over a rib 166 on the outer surface of the connector body 104. In that regard, the inward barb 164 engages the rib 166 to maintain compression sleeve 160 in the second position with respect to connector body 104.

It is contemplated that the engagement between insulated jacket 68 and the connector body 12 establishes a sealed engagement. In order to further facilitate the seal, compression sleeve 14 may optionally support a sealing O-ring (not shown) which provides a seal with the outer surface of the connector body 104 in the second position.

During installation of the connector 100 to an interface port 14, the coupler 106 threadably engages the interface port 14. As the coupler 106 is fastened to the interface port 14, for example, by rotating the coupler 106 relative to the interface port 14, the interface port 14 is drawn toward the forward flange 114 of the outer conductor engager 102. The free end of the interface port 14 has a sloped edge configured such that as the coupler 106 is tightened on the interface port 14, the sealing member 190 is expanded radially outward and compressed in the radially outward direction against the recess surface located in the coupler 106 to provide a weatherproof seal therebetween. The coupler 106 rotates and moves axially relative to the outer conductor engager 102, the connector body 104, and the cable 4, all of which are axially and rotatably fixed relative to one another. When fully tightened, the front surface 112 of the flange will make direct contact with the interface port 14.

The embodiment of the present disclosure provides an apparatus and method for producing a reliable electrical ground, a secure mechanical connection, and a plurality of watertight seals to protect a coaxial cable connector. The apparatus and method eliminates the need to fold the outer conductor over the compliant outer jacket 52 of the coaxial cable 4. Connector 100 has the advantage of being easier to attach to the cable, because it is easier and requires less force to compress engager 102 to outer conductor 50, than to insert a post between outer conductor 50 and jacket 52, and subsequently crimp the connector.

In several embodiments, coupler 106 and engager 102 are the only components of connector 100 that are made of a conductive material, such as a metal. The remainder of the components can be produced using inexpensive insulative materials such as polymer, which reduces the manufacturing cost of connector 100. Connector 100 has the further advantage of applying force to the coaxial cable over a broader area than prior designs, due to the wider, more rounded profile of fingers 120. This results in a firmer coupling, makes the cable less susceptible to breakage, and makes connector 100 less susceptible to incurring leaks, especially when the cable is bent.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A connector for a coaxial cable, comprising:

a coupler portion configured to engage an interface port;

a housing portion having a forward end configured to be disposed at least partially within the coupler portion; and an outer conductor engager portion made of a conductive material disposed within the housing portion, wherein the housing portion includes a rearward end configured to receive the coaxial cable, wherein the housing portion includes a nose cone, a body, and a sleeve, the sleeve surrounding the body, and the body and the sleeve being configured to slide axially relative to the nose cone, wherein the housing portion is configured to move axially relative to the outer conductor engager portion, wherein an interior surface of the housing portion is configured to compress the outer conductor engager portion when the housing portion is moved axially relative to the outer conductor engager portion such that an interior surface of the outer conductor engager portion is compressed radially inward against an outer conductor of the coaxial cable, wherein the outer conductor engager portion is configured to remain axially stationary relative to the coupler portion when the housing portion moves relative to the outer conductor engager portion, wherein a forward body portion of the housing portion is configured to be received by a reward end of the coupler portion and a rearward body portion is configured to be coupled with the forward body portion, wherein the coupler portion is configured to rotate relative to the forward body portion, wherein the rearward body portion is configured to slide axially relative to the forward body portion, wherein an interior surface of the rearward body portion is configured to compress the outer conductor engager portion when the housing portion is moved axially relative to the outer conductor engager portion such that an interior surface of the outer conductor engager portion is compressed radially inward against an outer conductor of the coaxial cable, wherein the outer conductor engager portion includes resilient fingers that are configured to be compressed radially inward against an outer conductor of the coaxial cable when an interior surface of the rearward body portion compresses the outer conductor engager portion, wherein a compression sleeve is configured to be disposed at a rearward end of the rearward body portion, wherein the compression sleeve is configured to move the rearward body portion axially forward relative to the forward body portion to compress the resilient fingers radially inward against the outer conductor of the coaxial cable, and wherein the compression sleeve is configured to move axially forward relative to the rearward body portion, after the resilient fingers are compressed radially inward against the outer conductor of the cable, so as to compress the rearward end of the rearward body portion against the coaxial cable.

2. The connector of claim 1, wherein the coupler portion, the forward body portion, the rearward body portion, and the outer conductor engager portion are separate structures that are coupled to one another.

3. The connector of claim 1, further comprising a terminal pin configured to receive a center conductor of the coaxial cable, wherein the terminal pin is configured to extend through the coupler portion and to be connected to the interface port.

4. The connector of claim 3, further comprising an isolator configured to electrically isolate the terminal pin from the coupler portion and/or an isolator configured to electrically isolate the center conductor from the outer conductor engager portion.

5. A connector for a coaxial cable, comprising:

a coupler portion configured to engage an interface port;

a housing portion having a forward end configured to be disposed at least partially within the coupler portion; and an outer conductor engager portion made of a conductive material disposed within the housing portion, wherein the housing portion includes a rearward end configured to receive the coaxial cable, wherein the housing portion includes a nose cone, a body, and a sleeve, the sleeve surrounding the body, and the body and the sleeve being configured to slide axially relative to the nose cone, wherein the housing portion is configured to move axially relative to the outer conductor engager portion, and wherein an interior surface of the housing portion is configured to compress the outer conductor engager portion when the housing portion is moved axially relative to the outer conductor engager portion such that an interior surface of the outer conductor engager portion is compressed radially inward against an outer conductor of the coaxial cable.

6. The connector of claim 5, wherein the outer conductor engager portion is configured to remain axially stationary relative to the coupler portion when the housing portion moves relative to the outer conductor engager portion.

7. The connector of claim 5, wherein the housing portion comprises:

a forward body portion configured to be received by a reward end of the coupler portion;

a rearward body portion coupled with the forward body portion; and a sleeve portion surrounding the rearward body portion, wherein the coupler portion is configured to rotate relative to the forward body portion, wherein the rearward body portion and the sleeve portion are configured to slide axially relative to the forward body portion, and wherein an interior surface of the rearward body portion is configured to compress the outer conductor engager portion when the housing portion is moved axially relative to the outer conductor engager portion such that an interior surface of the outer conductor engager portion is compressed radially inward against an outer conductor of the coaxial cable.

8. The connector of claim 7, wherein the outer conductor engager portion includes resilient fingers that are configured to be compressed radially inward against an outer conductor of the coaxial cable when an interior surface of the rearward body portion compresses the outer conductor engager portion.

9. The connector of claim 8, further comprising:

a compression sleeve disposed at a rearward end of the rearward body portion, wherein the compression sleeve is configured to move the rearward body portion axially forward relative to the forward body portion to compress the resilient fingers radially inward against the outer conductor of the coaxial cable.

10. The connector of claim 6, wherein the compression sleeve is configured to move axially forward relative to the rearward body portion, after the resilient fingers are compressed radially inward against the outer conductor of the cable, so as to compress the rearward end of the rearward body portion against the coaxial cable.

11. The connector of claim 5, wherein the coupler portion is configured to rotate relative to the housing portion.

12. The connector of claim 5, wherein the outer conductor engager portion includes resilient fingers that are configured to be compressed radially inward against an outer conductor of the coaxial cable when the housing portion is moved axially relative to the outer conductor engager portion.

13. The connector of claim 12, further comprising:

a compression sleeve disposed at a rearward end of the housing portion, wherein the compression sleeve is configured to move the housing portion axially forward relative to the outer conductor engager portion to compress the resilient fingers radially inward against the outer conductor of the coaxial cable.

14. The connector of claim 13, wherein the compression sleeve is configured to move axially forward relative to the housing portion, after the resilient fingers are compressed radially inward against the outer conductor of the cable, so as to compress the rearward end of the housing portion against the coaxial cable.

15. The connector of claim 5, further comprising a terminal pin configured to receive a center conductor of the coaxial cable, wherein the terminal pin is configured to extend through the coupler portion and to be connected to the interface port.

16. The connector of claim 15, further comprising an isolator configured to electrically isolate the terminal pin from the coupler portion and/or an isolator configured to electrically isolate the center conductor from the outer conductor engager portion.

17. The connector of claim 5, wherein the coupler portion, the housing portion, and the outer conductor engager portion are separate structures that are coupled to one another.

18. A connector for a coaxial cable, comprising:

a coupler configured to engage an interface port;

a housing having a forward end configured to be disposed at least partially within the coupler portion; and an outer conductor engager disposed within the housing portion, wherein the housing includes a nose cone, a body, and a sleeve, the sleeve surrounding the body, and the body and the sleeve being configured to slide axially relative to the nose cone, wherein the housing is configured to move axially relative to the outer conductor engager, and wherein an interior surface of the housing is configured to compress the outer conductor engager when the housing is moved axially relative to the outer conductor engager such that an interior surface of the outer conductor engager is compressed radially inward against an outer conductor of the coaxial cable.

19. The connector of claim 18, wherein the outer conductor engager includes resilient fingers that are configured to be compressed radially inward against an outer conductor of the coaxial cable when the housing is moved axially relative to the outer conductor engager.

20. The connector of claim 19, further comprising:

a compression sleeve disposed at a rearward end of the housing, wherein the compression sleeve is configured to move the housing axially forward relative to the outer conductor engager to compress the resilient fingers radially inward against the outer conductor of the coaxial cable.

* * * * *